US008668007B2

(12) United States Patent
Casassa et al.

(10) Patent No.: US 8,668,007 B2
(45) Date of Patent: Mar. 11, 2014

(54) NON-ROTATING CASING CENTRALIZER

(75) Inventors: Garrett C. Casassa, Anaheim, CA (US); Sarah B. Mitchell, Tustin, CA (US); Norman Bruce Moore, Aliso Viejo, CA (US)

(73) Assignee: WWT International, Inc., Houston, TX (US)

( * ) Notice: Subject to any disclaimer, the term of this patent is extended or adjusted under 35 U.S.C. 154(b) by 530 days.

(21) Appl. No.: 12/912,615

(22) Filed: Oct. 26, 2010

(65) Prior Publication Data

US 2011/0114338 A1 May 19, 2011

(51) Int. Cl.
*E21B 17/10* (2006.01)

(52) U.S. Cl.
USPC ..... 166/241.6; 175/325.1

(58) Field of Classification Search
USPC ..... 175/325.1, 323, 325.5, 325.6, 325.7; 166/241.6, 241.7
See application file for complete search history.

(56) References Cited

U.S. PATENT DOCUMENTS

| | | | | |
|---|---|---|---|---|
| 2,318,878 | A | | 5/1943 | Miller |
| 2,727,576 | A | | 12/1955 | Hall |
| 2,886,111 | A | | 5/1959 | Hall |
| 3,172,475 | A | | 3/1965 | Moore |
| 3,197,262 | A | | 7/1965 | Fairchild |
| 3,237,696 | A | | 3/1966 | Hall, Sr. |
| 3,292,705 | A | | 12/1966 | Hall, Sr. |
| 3,397,017 | A | | 8/1968 | Grant et al. |
| 3,410,613 | A | | 11/1968 | Kuus |
| 3,963,075 | A | | 6/1976 | Evans |
| 4,088,185 | A | | 5/1978 | Carson |
| 4,458,404 | A | * | 7/1984 | Garrett ..... 29/455.1 |
| 4,766,663 | A | | 8/1988 | Milam |
| 4,984,633 | A | | 1/1991 | Langer et al. |
| 5,069,297 | A | | 12/1991 | Krueger et al. |
| 5,095,981 | A | | 3/1992 | Mikolajczyk |
| 5,566,754 | A | | 10/1996 | Stokka |
| 5,692,562 | A | | 12/1997 | Squires |
| 5,797,455 | A | | 8/1998 | Barron et al. |
| 5,803,193 | A | | 9/1998 | Krueger et al. |
| 5,908,072 | A | | 6/1999 | Hawkins |
| 5,937,948 | A | | 8/1999 | Robbins, III |

(Continued)

FOREIGN PATENT DOCUMENTS

| | | |
|---|---|---|
| GB | 2 290 331 A | 12/1995 |
| WO | WO 98/50669 | 11/1998 |

OTHER PUBLICATIONS

International Search Report and Written Opinion dated Dec. 15, 2010, for International Application No. PCT/US2010/054144, filed Oct. 26, 2010.

*Primary Examiner* — David Bagnell
*Assistant Examiner* — Kipp Wallace
(74) *Attorney, Agent, or Firm* — Christie, Parker & Hale, LLP

(57) ABSTRACT

A non-rotating downhole sleeve adapted for casing centralization in a borehole. The sleeve includes a tubular body made of hard plastic with integrally formed helical blades positioned around its outer surface and an inner surface which allows drilling fluid to circulate to form a non-rotating fluid bearing between the sleeve and the casing. The tubular sleeve comprises a continuous non-hinged wall structure for surrounding the casing. The non-rotating centralizer sleeve reduces sliding and rotating torque at the surface while drilling the casing, for example, with minimal obstruction to drilling fluid passing between the casing and the surrounding borehole.

18 Claims, 13 Drawing Sheets

(56) References Cited

U.S. PATENT DOCUMENTS

| | | | | |
|---|---|---|---|---|
| 6,006,830 | A | 12/1999 | Barron et al. | |
| 6,032,748 | A * | 3/2000 | DeBray et al. | 175/325.7 |
| 6,250,405 | B1 | 6/2001 | Moore et al. | |
| 6,283,205 | B1 | 9/2001 | Cannon | |
| 6,378,633 | B1 | 4/2002 | Moore et al. | |
| 6,401,820 | B1 | 6/2002 | Kirk et al. | |
| 6,435,275 | B1 | 8/2002 | Kirk et al. | |
| 6,513,223 | B1 | 2/2003 | Angman et al. | |
| 6,585,052 | B2 | 7/2003 | Angman et al. | |
| 6,666,267 | B1 | 12/2003 | Charlton | |
| 6,705,413 | B1 | 3/2004 | Tessari | |
| 6,725,939 | B2 | 4/2004 | Richard | |
| 6,830,102 | B2 | 12/2004 | Kirk et al. | |
| 6,845,816 | B2 | 1/2005 | Kirk et al. | |
| 7,044,241 | B2 | 5/2006 | Angman | |
| 7,055,631 | B2 | 6/2006 | Mitchell et al. | |
| 7,082,997 | B2 | 8/2006 | Slack | |
| 7,159,668 | B2 | 1/2007 | Herrera | |
| 7,195,730 | B2 | 3/2007 | Calderoni et al. | |
| 7,357,178 | B2 | 4/2008 | Thornton | |
| 7,604,059 | B2 | 10/2009 | Thornton | |
| 7,708,064 | B2 | 5/2010 | Sehsah | |
| 7,814,633 | B2 * | 10/2010 | Slack | 29/421.1 |
| 2003/0019637 | A1 | 1/2003 | Slack et al. | |
| 2005/0224123 | A1 | 10/2005 | Baynham et al. | |
| 2006/0231250 | A1 | 10/2006 | Slack | |
| 2007/0163778 | A1 | 7/2007 | Wheeler et al. | |
| 2008/0217063 | A1 | 9/2008 | Moore et al. | |
| 2009/0242193 | A1 | 10/2009 | Thornton | |

* cited by examiner

NON-ROTATING CASING CENTRALIZER

CROSS-REFERENCE TO RELATED APPLICATIONS

This application claims priority to U.S. Provisional Application Nos. 61/281,184, filed Nov. 13, 2009, and 61/340,062, filed Mar. 11, 2010, which are incorporated herein in their entirety.

FIELD OF THE INVENTION

This invention relates to gas and oil production, and more particularly, to improvements in open hole drilling with drill pipe and in casing centralization. Both drilling applications are improved upon by the present invention's use of specially designed non-rotating drill pipe protectors applied to the rotating drill pipe or casing.

BACKGROUND (a) Open Hole Non-Rotating Drill Pipe Protector: Recently new drilling and fracturing technology has allowed unconventional development for gas and oil production. Examples of major field developments include the Baaken play in North Dakota, the Marcellus play of Pennsylvania, and the Haynesville play of east Texas and Louisiana. These huge development opportunities have spawned the need for new technologies to develop these resources in these types of wells.

One characteristic of these formations and other formations, especially on land, is that the pay zones may be relatively shallow (5000-12000 feet) and may be relatively thin in their thickness (10-200 feet). These thin formations frequently are exploited by the use of horizontal well profiles, after reaching pay zone depth. When the formations are relatively firm, the hole is frequently not completely cased. Thus, a casing shoe will be placed near the build section (region where the orientation of the wellbore changes from vertical to horizontal). Entrance into and out of the casing with drill pipe or casing is subject to problems of high torque, drag, and buckling.

Another similar problem with respect to drilling into horizontals occurs in multilateral wells. In these wells, multiple sidetrack wells are drilled from a primary wellbore. Again, either drill pipe is run through the sidetrack; or in some cases, slotted liners are installed with the frequent problems of high torque, drag, or buckling.

Another recent development in drilling technology is the use of a single drilling pad to drill multiple directional wells to produce from a reservoir with a minimum of cost and environmental impact. These wells generally have shallow surface casing setting depths. Being directional in nature, they can generate high drilling torque, requiring both larger and more expensive equipment or shallower wells that may result in incomplete access to the reservoir.

An essential part of the drilling and completion of these wells is the drilling with drill pipe, and subsequently, running casing into the hole and cementing the casing into place. A variation of this, that may be used in shallower wells and low angle deviated wells, is to drill with casing and then retract the drilling assembly and cement the casing in place.

For each method, a common problem is that the torque in the drill string may become so excessive that required torque is greater than the top drive (or rotary equipment) and may exceed the capabilities of the equipment. Also, the process of sliding the drilling string downhole while drilling, with or without a motor, may be significant because of the high friction between (1) drill pipe and casing, or (2) drill pipe and open hole formation, or (3) casing and formation, or (4) casing within casing.

(b) Casing Centralizer: Casing centralization is of importance to oil and gas wells because proper centralization of the casing within the hole leads to improved cementing of the casing, and hence, pressure integrity and safety. Centralizers are also important to allow use of slotted liners to avoid slot plugging, reduce drag during installation, and limit differential sticking of the casing to the formation during installation.

Historically, many different attempts were made to satisfy the multiple requirements for proper casing centralization; but these have failed because only one or two of the performance requirements were satisfied in previous designs. These requirements include the need to keep the casing in the center of the hole, allowing the cement to be evenly distributed around the casing. This centralization is difficult because of wellbore configuration and common drilling problems. For example, in non-vertical wells, such as extended reach wells or horizontal wells, the casing's weight forces the casing to the low side of the hole; without centralization, the casing will sit on the bottom side of the hole and prevent proper cementation. Further, certain drilling curvatures occur in the wellbore trajectory caused by variations in rock hardness and orientation; these are commonly called "dog-legs," and can result in the casing contacting the hole wall in a non-concentric manner.

Also part of casing centralization is efficient passage of the cement past the centralizer towards the surface. If the centralizer fills a significant portion of the annulus between the casing and the wellbore, the result is restriction of the cement flow, thus requiring greater pumping, but more often incomplete cement coverage.

Another common problem occurs when running a smaller casing liner through a casing exit without a whipstock in place. For these applications, failure of the centralizers run on liners through casing exits can result in expensive time lost due to fishing (retrieving parts) and milling of pieces of centralizers in order to obtain proper well function. This significant problem is associated with the transition across the sharp edge of the casing and into open hole.

Another problem with the use of casing centralizers occurs when utilizing casing for drilling operations. This technique utilizes the casing and especially top drive and bottom hole assemblies (BHAs) to drill with the casing, then retrieve the BHA, and cement the casing. Drilling with casing can produce a significant time and cost savings. However, a common problem is that the casing centralizers contact the hole wall and casing, resulting in substantially increased torque, sometimes at or near the limitations of the surface equipment or casing.

(c) Prior Art Non-Rotating Drill Pipe Protectors: Non-Rotating Drill Pipe Protectors (NRDPPs) have been used to reduce torque between drill pipe and casing. (See U.S. Pat. Nos. 5,692,563; 5,803,193; 6,250,405; 6,378,633; and 7,055,631, assigned to Western Well Tool, Inc.) These patents describe particular designs of drill pipe protector sleeves and related assemblies having features that reduce torque, reduce sliding friction, and assist in increasing drill string buckling loads when strategically placed on the drill pipe.

However, these designs have typically been limited to cased hole applications, not open hole applications. A problem may occur with the prior art designs in transitioning from casing to open hole. In some applications, the end of the casing may have washouts that result in a large diametrical difference of the hole to the casing, producing a hazard that can catch the non-rotating drill pipe protector. This can damage one or more NRDPP assemblies, and could result in lost rig time. Also, at casing transitions, the end of the casing can have a sharp edge resulting from the milling process; here again a hazard that can result in snagging the NRDPP at the transition and damaging the sleeve and the NRDPP assembly, possibly resulting in lost rig time and associated expenses. Further, when in open hole the abrasive nature of the formation on NRDPPs of traditional materials can result in excessive wear. Also, many materials used in NRDPPs do little to reduce drag between the drill pipe and the casing; it is advantageous to have designs that reduce drag.

(d) Prior Art Casing Centralizers: Casing centralizers have been used in the past, but with limited success. These include the centralizers disclosed in U.S. Pat. Nos. 5,908,072 to Hawkins, 6,435,275 to Kirk et al., 6,666,267 to Charlton, and U.S. application publication US 2009/0242193 to Thornton. Each of these centralizers has significant deficiencies.

Specifically, Hawkins '072 teaches a tubular centralizer of unitary construction with radially projecting blades. The centralizer contains a cylindrical bore having a bearing surface that makes a close fit around the casing. The centralizer can be bonded to the casing. The contact bearing surface described in Hawkins can have coefficients of friction of 0.30, with its close fit around the casing, thus substantially increasing torque when rotating and running casing into a well.

Kirk et al. '275 teaches a centralizer that has a clearance fit around the casing; but clearance fits result in contact bearing surfaces which produce coefficients of friction of 0.3 for typical plastics, resulting in significantly greater torque at the surface.

Charlton '267 teaches a tubular centralizer sleeve of unitary construction with a clearance fit and ID grooves that taper in depth longitudinally, also non-optimum, because it does not produce or allow a low friction bearing surface that reduces torque at the surface.

Thornton '193 teaches a centralizer also having a clearance fit around the casing, to produce a contact bearing surface that functions as a thrust bearing or a journal bearing during use. The centralizer also contains a polymeric outer sleeve, with an inner liner or tubular end sections of a more rigid material, along with a coating of tungsten disulphide to reduce friction. The performance attributed to the centralizer is not supported by measurements based on use simulating actual downhole environments.

In summary, the current art for casing centralizers used for drilling, or for simply running casing, do not entirely address the combined issues of high torque, high sliding friction, resistance to damage when running over obstacles, and maximizing fluid flow past the centralizer.

SUMMARY OF THE INVENTION

Briefly, one embodiment of the invention comprises a non-rotating downhole sleeve adapted for casing centralization in a borehole. The centralizer can be used when drilling with casing or when using casing for landing downhole tools in a borehole, for example. The sleeve includes a tubular body made of hard plastic with integrally formed helical blades positioned around its outer surface and an inner surface which allows drilling fluid to circulate to form a non-rotating fluid bearing between the sleeve and the casing. The non-rotating centralizer sleeve reduces sliding and rotating torque at the surface while drilling the casing, for example, with minimal obstruction to drilling fluid passing between the casing and the surrounding borehole.

Another embodiment of the invention comprises a non-rotating casing centralizer adapted for use with a casing disposed in a borehole, in which the casing centralizer comprises a tubular sleeve having an inside surface adapted to surround a section of casing, the inside surface of the sleeve having circumferentially spaced apart axially extending grooves positioned between substantially flat bearing surface regions for contacting the outer surface of the casing. The axial grooves allow fluid to circulate therethrough to form a non-rotating fluid bearing upon circulation of fluid under pressure between the inside surface of the sleeve and the casing. The tubular sleeve also includes a plurality of helical blades integrally formed with and projecting from an outer surface of the sleeve. The helical blades have outer surfaces adapted for contact with the borehole, the helical blades, providing a flow path for fluid passing between the blades, the flow path passing through the borehole between upper and lower ends of the tubular sleeve. The tubular sleeve compresses a continuous non-hinged structure for surrounding the casing, and a metal cage embedded in the sleeve to reinforce the continuous wall structure of the sleeve. The reinforcing cage is made of heat-treatable steel.

Other embodiments of the invention include:

- The centralizer sleeve is made from a molded ultra high molecular weight polyethylene having a molecular weight greater than about two million.
- The tubular sleeve comprises an interior liner forming said fluid bearing and a tubular outer section made from a molded polymeric material integrally formed with the helical blades, the inner liner bonded to the tubular outer section, the inner liner having a hardness less than the hardness of the tubular outer section.
- The inner liner is made from a rubber-containing material having a Shore A hardness from about 55 to about 75, and the tubular outer section is made from ultra high molecular weight polyethylene.
- The sleeve compresses a solid body made of compression molded ultra high molecular weight polyethylene.
- The tubular sleeve comprises a molded polymeric material, and in which the reinforcing cage structure is made from heat-treatable steel having a thickness of at least about 0.065 inch.
- The molded tubular centralizer sleeve comprises ultra high molecular weight polyethylene having an average compressive loading resistance of at least about 40,000 lbs.
- The centralizer sleeve has a sliding coefficient of friction and a rotating coefficient of friction of 0.10 or less.

These and other aspects of the invention will be more fully understood by referring to the following detailed description and the accompanying drawings.

BRIEF DESCRIPTION OF THE DRAWINGS

DETAILED DESCRIPTION (a) Casing Centralizer Drilling Apparatus: FIG. 1A illustrates one embodiment of the invention in which a non-rotating casing centralizer assembly is used in an underground wellbore drilling assembly. The drilling assembly includes a drilling rig 20 from which a wellbore 22 is drilled in an underground formation 24. The wellbore, as shown in the drawing, is drilled in a vertical orientation, although the wellbore may deviate from vertical. The illustrated embodiment shows the process of drilling with casing, in which the borehole is being drilled with a rotary drill bit 26 installed at the bottom of a string of casing 28. Multiple lengths of the casing are installed between vertically spaced apart casing couplings 30 as drilling progresses down hole.

Centralization during drilling is carried out with separate lengths of non-rotating casing centralizer sleeves 32 (and their related assemblies) positioned on the casing between the couplings. One or more centralizer assemblies can be used between each adjacent pair of couplings.

Figures 1A, 1B:
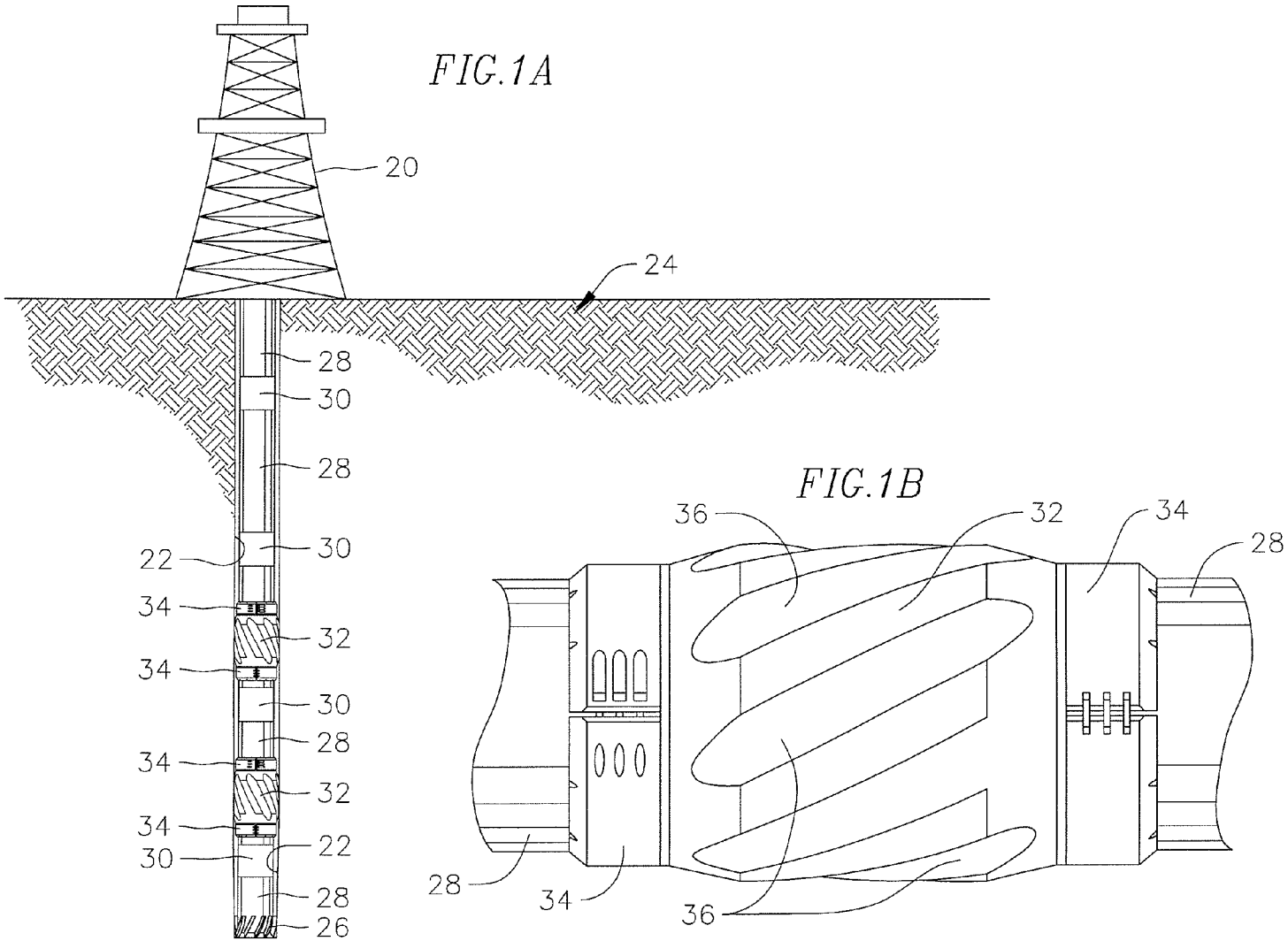
FIG. 1A is a schematic side view showing a wellbore having a drilling apparatus using a non-rotating casing centralizer assembly according to one embodiment of this invention.
FIG. 1B is a schematic side elevational view showing one embodiment of a casing centralizer assembly in use in FIG. 1A.

The non-rotating centralizer sleeves 32 are shown in more detail in FIG. 1B. Each centralizer sleeve is positioned between upper and lower stop collar assemblies 34. The non-rotating casing centralizer assembly is described in more detail below.

As shown in FIG. 1B, the non-rotating centralizer sleeve body 32 includes circumferentially spaced apart helical blades 36 projecting from the outside diameter (OD) of the sleeve.

FIGS. 1A and 1B illustrate one use of the invention for casing centralization. In addition to drilling with casing, the centralizer also may be used when the casing is used for landing downhole tools in a wellbore, or when running in casing in a wellbore, to center the casing while flowing drilling fluid around it or cementing in the casing.

In addition to the present invention as illustrated in FIGS. 1A and 1B, the open hole drilling assembly has application to other drilling systems such as casing centralization when drilling with casing, for example. Both drilling applications are improved upon by the non-rotating drill pipe protector or centralizers described herein.

(b) Casing Centralizer and Open Hole Protector Design Criteria: The general design objectives for the casing centralizer and/or open hole protector sleeves of this invention have the following performance criteria:

(1) Casing Centralizer Body or Open Hole Protector Sleeve Does Not Contact Formation or Casing: The geometry of the blades of the centralizer and open hole protector sleeve are spaced such that only the blades (and not the tubular body) contact the formation during running or casing when exiting casing. Contacting only the blades is required both in the circumferential axis and longitudinal axis, thus reducing or preventing damage from contact to protruding surfaces.

(2) Centralizer Blades And Open Hole Protector Sleeves Provide at Least Two Contact Points: The blades are oriented such that during slow rotation at least two blades will be in contact with the casing exit or the formation.

(3) Centralizer or Open Hole Protector Sleeve Length: The centralizer has a sufficient length and height such that the casing coupling being installed can easily pass an outer casing exit without contact, or similarly, the drill pipe can pass an outer casing. The centralizer and drill pipe protector sleeve also are of sufficient length to allow for a substantial reduction in friction between the casing and the formation, the drill pipe and the casing, the centralizer and the casing, and the protector sleeve and the drill pipe, through the use of design features and materials described below.

(4) Casing Centralizer Material Properties: Material properties of the centralizer include resistance to drilling muds, completion fluids, and common wellbore products. The centralizer has sufficient tear strength to resist resulting tearing shear loads and compressive loads (across casing exits or across formations) in excess of normal expected side loads (500-10,000 lbs). It has sufficiently low coefficient of friction to result in the coefficient of friction between the centralizer and the formation, and between the centralizer and the casing, being less than the coefficients of friction between the casing and formation alone (typically COF=0.2-0.5)

Figure 2B:
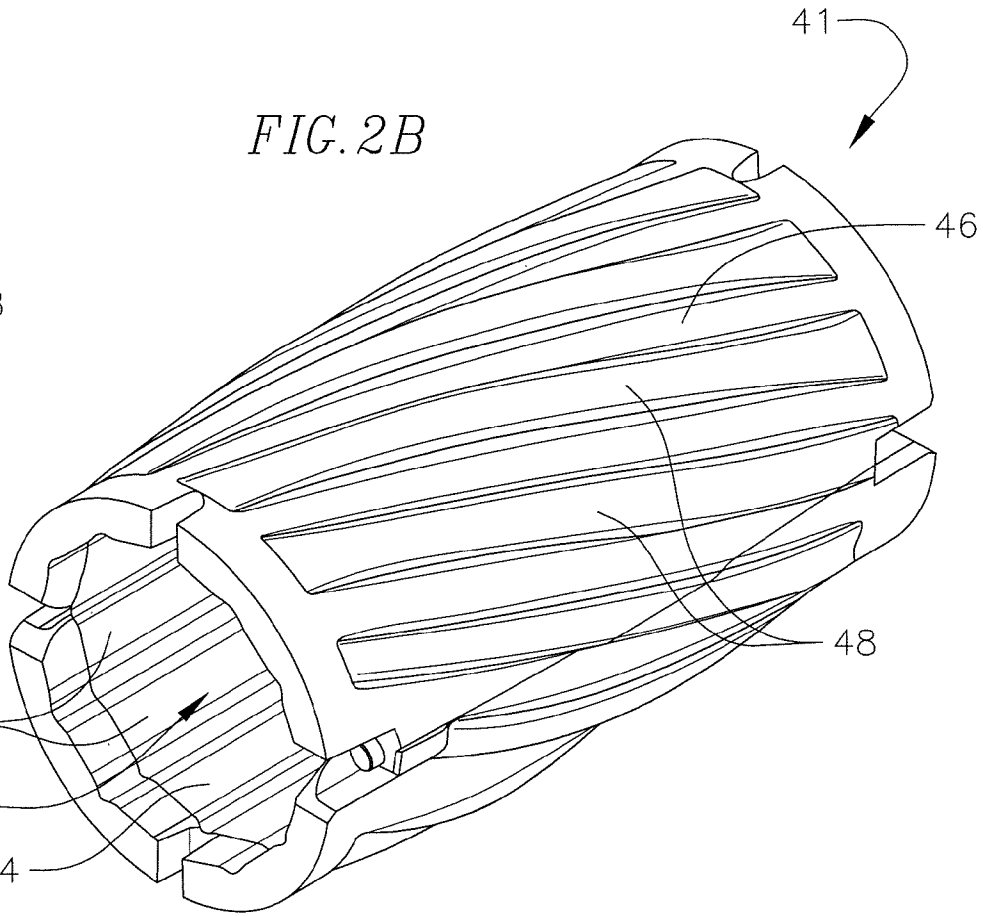
FIGS. 2A and 2B are perspective views showing an improved casing centralizer or open hole drill pipe protector sleeve according to principles of this invention.
Figure 2A:
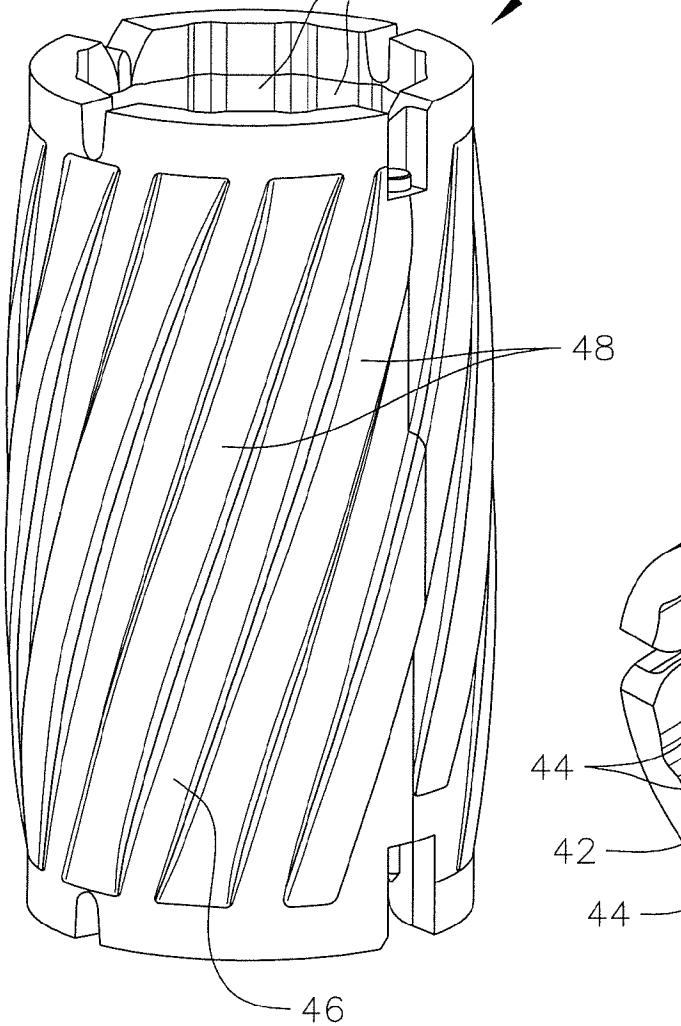

(c) Casing Centralizer Construction: FIGS. 2A and 2B show an improved casing centralizer 40 according to one embodiment of this invention. The centralizer 41 includes (1) an internal fluid bearing 42 with multiple rectangular (non tapered) flats 44 which may consist of a soft material such as rubber, or a soft urethane; the fluid bearing can be a rubber or urethane liner, or in the alternative, the fluid bearing may be constructed of an ultra high molecular weight polyethylene, as described below; (2) an internal cage reinforcement (described below) made of steel with multiple perforations to allow centralizer material to communicate to both sides of the cage; (3) one or more hinges (described below) with associated pin(s) made of high strength steel or stainless steel; alternatively the centralizer may have a continuous metal reinforcement that does not include a hinge; and (4) a molded body 46 made of plastic, preferably Ultra High Molecular Weight Polyethylene (UHMWPE), with multiple integrally molded helical blades 48 on the exterior of the centralizer. The blades have application-specific spacing, helical angle, blade height and width and material properties determined by application requirements, as described below.

Various types of stop collars 42 (see FIG. 1B) are used to hold the casing centralizer in place near the coupling. This invention may or may not use collars in field applications depending upon hole conditions as well as installation cost considerations. One example of a collar suitable for open hole applications is described below. Also, a simple ring (not shown) with set screws may be used as a stop collar in some applications.

(d) Open Hole Protector Sleeve And Casing Centralizer Design Features: The casing centralizer and open hole protector sleeve have specific features to provide: (1) optimal centralization to the hole, (2) low friction between the centralizer or sleeve and the formation and/or casing or drill pipe, (3) easier casing rotation by reducing the torque required to turn the casing, (4) rugged construction that resists damage during running, specifically exiting casing liners, and (5) large flow-by capability between the wellbore and casing, or the drill pipe and casing, taking into account the aforementioned features.

Figure 3B:
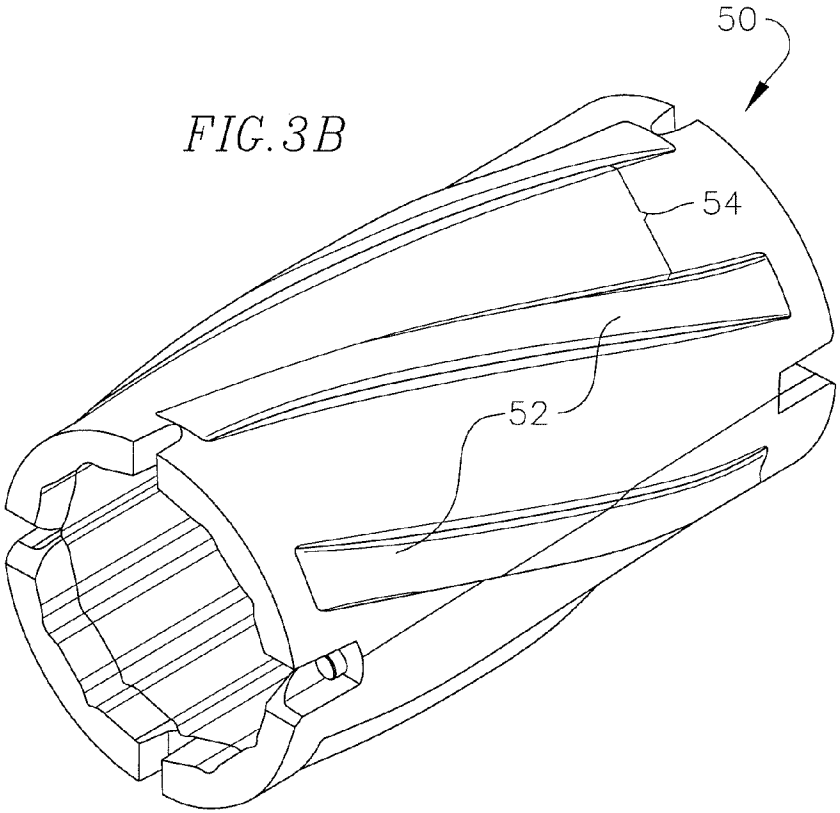
FIGS. 3A and 3B are perspective views showing a non-optimum blade configuration for blades on a casing centralizer or protector sleeve with an inadequate number of blades.
Figure 3A:
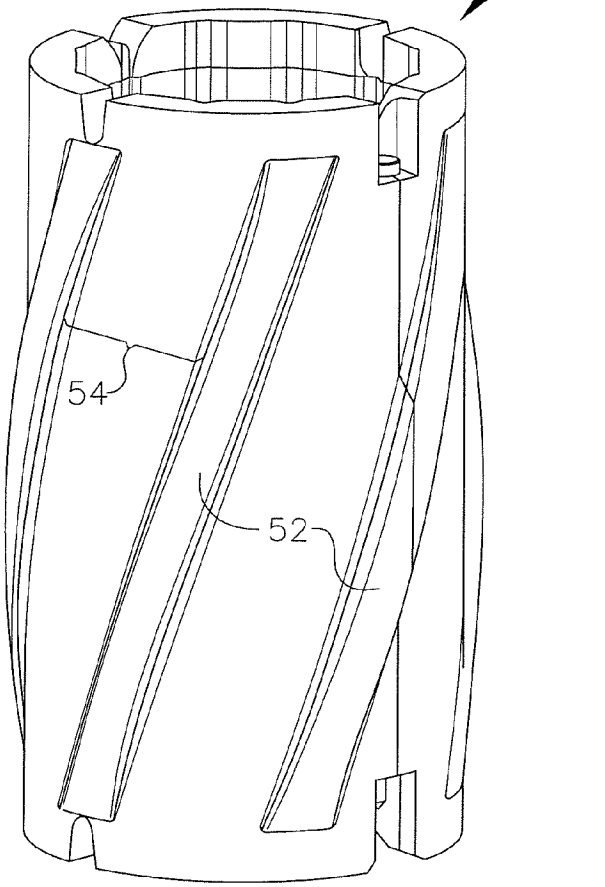

FIGS. 3A and 3B show a casing centralizer (or protector sleeve) 50 with a non-optimized blade spacing. In this example, there are six to seven helical blades 52, with blade spacing 54 exceeding the width of the blades. This illustrates an inadequate number of blades. In use, when the centralizer (or protector sleeve) is sliding past the formation, or when exiting an outer casing, it results in the casing centralizer body contacting the formation or casing, resulting in potential for damage to the centralizer during installation (possibly resulting in fishing or milling trips into the well).

Figure 4B:
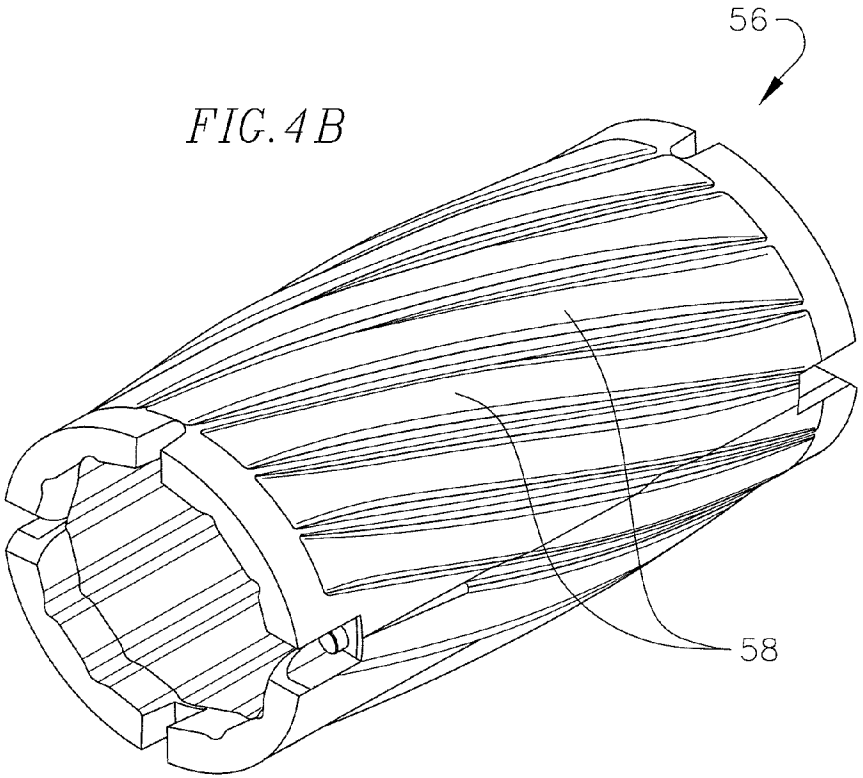
FIGS. 4A and 4B are perspective views showing a non-optimum blade configuration for a casing centralizer or protector sleeve with excessive blades.
Figure 4A:
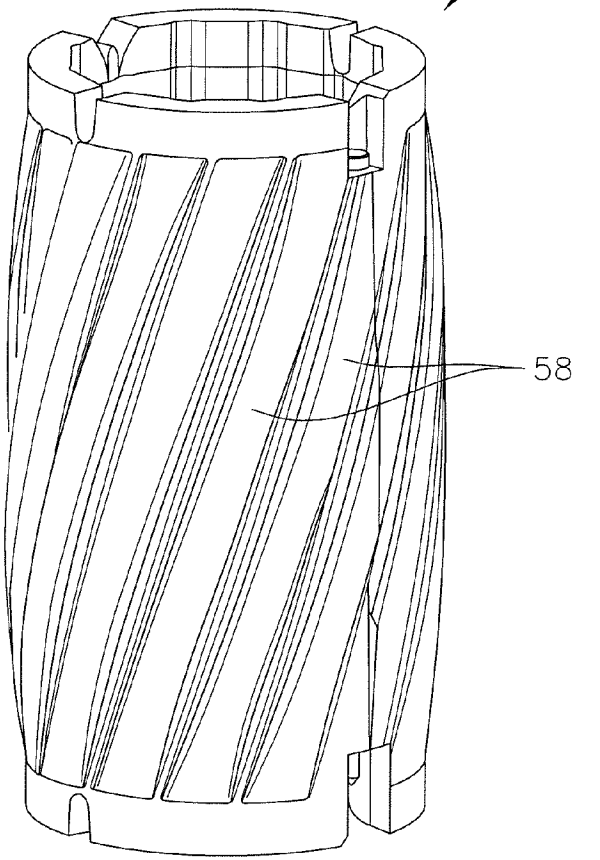

FIGS. 4A and 4B show a casing centralizer (or protector sleeve) 56 having non-optimized narrow blade spacing resulting from excessive blades 58, such that when the annulus area between the centralizer and the formation is restricted, it results in a poor cementing job for the casing.

Figure 5B:
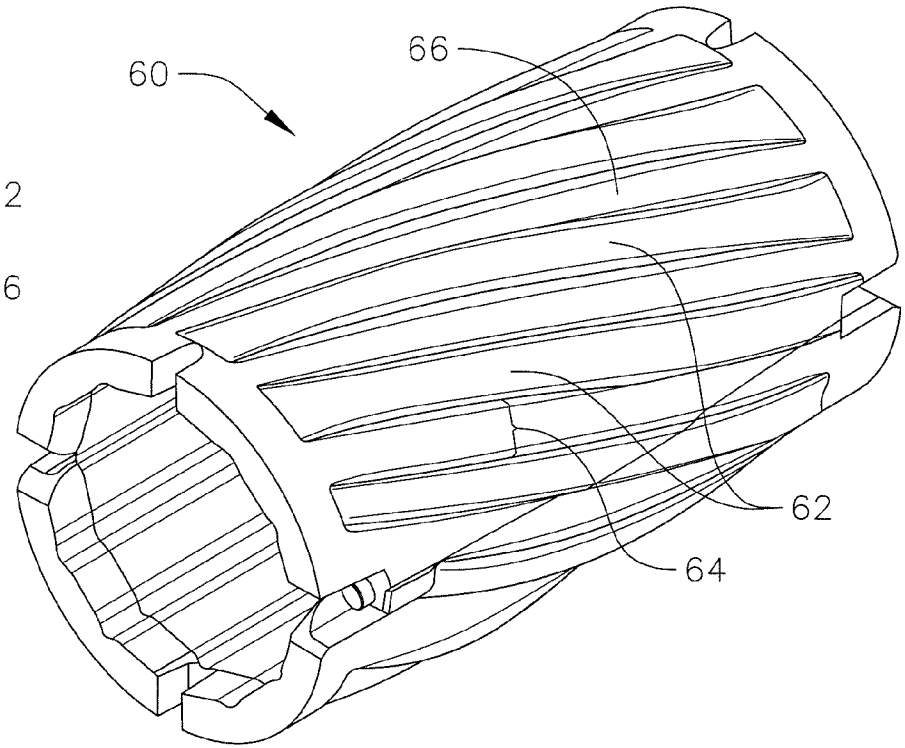
FIGS. 5A and 5B are perspective views showing an optimum blade configuration for a casing centralizer or protector sleeve for a casing or drill pipe.
Figure 5A:
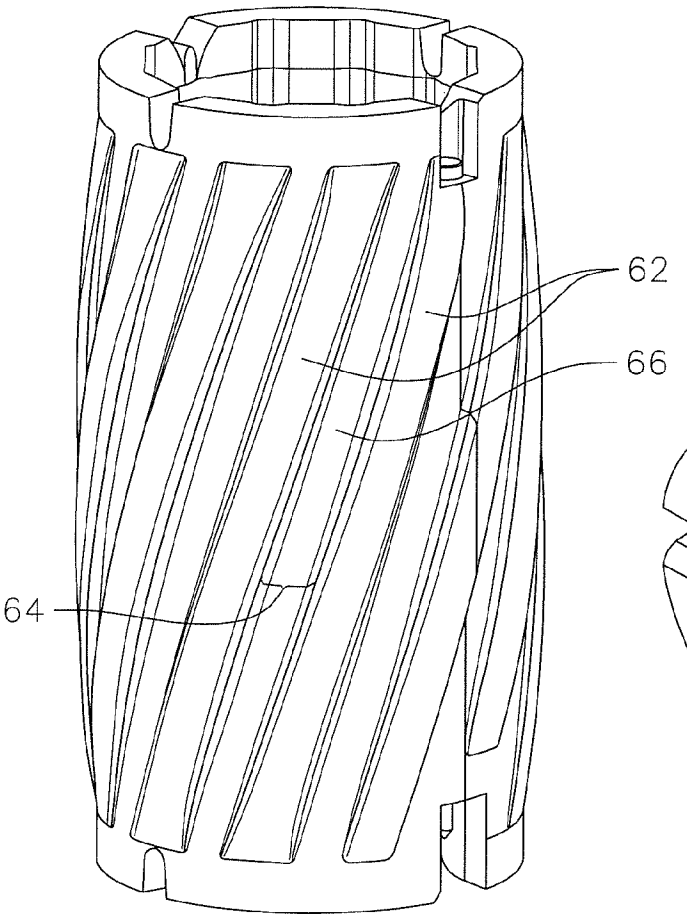

FIGS. 5A and 5B show a casing centralizer (or protector sleeve) 60 of this invention with optimized spacing between the blades 62. The blades are generally helical and of generally uniform height and width, extending generally parallel with essentially uniform spacing at 64 between blades. In the illustrated embodiment, the drill pipe protector sleeve is adapted for use in a 4.5-inch diameter drill pipe. In this embodiment, the body 66 of the sleeve is prevented from contact to formation or casing exit. As described in more detail below, the blade width and height are optimized to maximize cement or fluid flow-by. The body 66 of the sleeve (or centralizer) also has sufficient material properties (described below) to resist typical compressive loads on the blade, which could otherwise result in permanent deformation.

Figure 6:
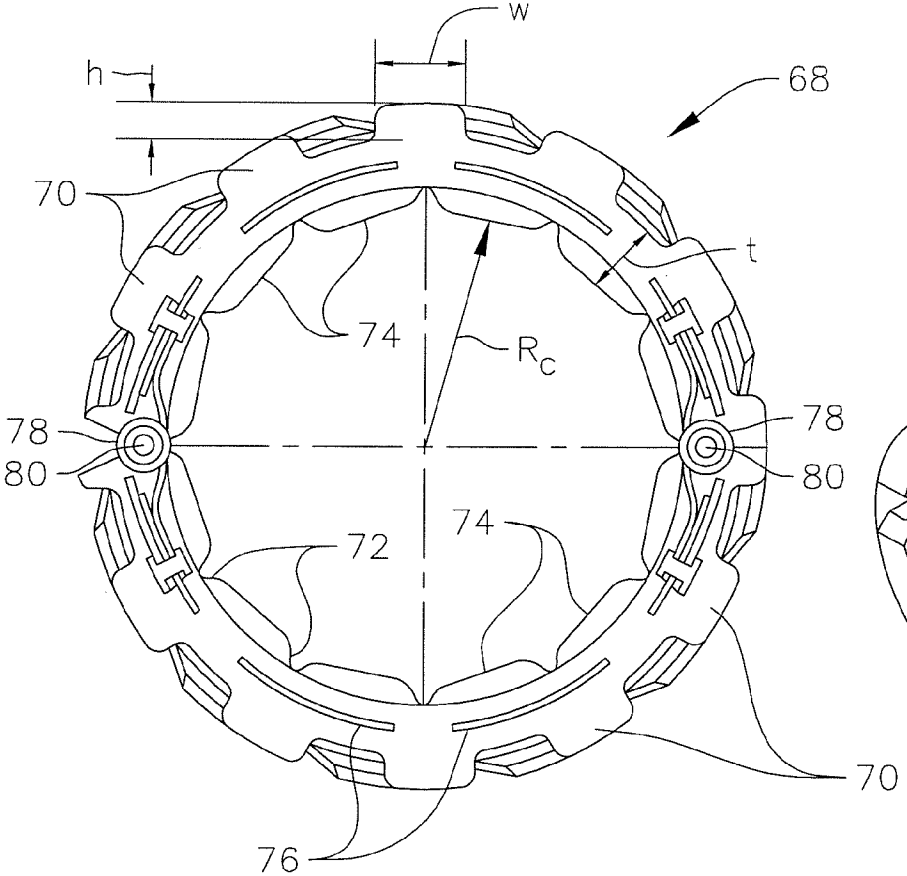
FIG. 6 is a schematic cross-sectional view illustrating parameters for a casing centralizer or open hole non-rotating drill pipe protector sleeve according to this invention.

Analytical evaluation of the environmental and geometrical factors experienced by casing centralizers has revealed significant relationships for the blade structure. Specific centralizer blade construction parameters are blade number (N), height (h), width (w), sleeve thickness (t) and radius ($R_c$). These geometric parameters are based on the compressive strength ($S_c$) and tear strength of the sleeve's body material. Several of these parameters are depicted in the centralizer 68 shown in FIG. 6, which also shows an optimal centralizer (or drill pipe protector sleeve) configuration which includes the helical exterior blades 70 and the internal fluid bearing consisting of the axial grooves 72 between parallel axial flats 74. The 72 grooves are of generally uniform depth from end to end, and the flats 74 are of generally uniform width from end to end. In one embodiment, the fluid bearing is formed by an internal liner bonded to the body of the sleeve. The liner and its fluid bearing are described in more detail below. FIG. 6 also illustrates portions of an internal reinforcing cage structure 76 embedded in the sleeve. The cage in this embodiment includes hinges 78 and hinge pins 80.

To maximize the number of blades and minimize flow restriction, the derivation of the optimal number of blades is based on the minimum desired width of the blades. This is a function of material tear strength properties. The design is preferably within a moderate safety factor to prevent failure under normal drilling conditions.

According to the invention, for a casing centralizer (or open hole drill pipe protector sleeve) with constant pitch blades, and considering the circumferential axis of the tool within the casing or hole, the relationship shown below in Equation (1) defines the minimum number of blades required on a sleeve that will prevent the sleeve body from contacting the casing, open hole wellbore, or a casing exit, thus preventing or reducing tearing or gripping of the centralizer or sleeve:

$$N = \pi \Big/ \cos^{-1}\left(\frac{R_c + t}{R_c + t + h}\right) \text{ (minimum blade number to ensure no contact while exiting a casing)} \qquad \text{Eq. (1)}$$

Equation (1) is solved iteratively. For the example of a 4.5-inch diameter (Rc) sleeve with 0.275 inch height (h) blades, the optimum number (N) of blades on the centralizer body to prevent contact is 8. For this example, fewer blades results in the potential for the casing centralizer to hang up and be damaged when exiting casing or have the formation catch and damage the centralizer body. A larger number of blades of the same size can result in a greater flow restriction, and poor cementation around the centralizer.

Further, the width and helix angle of the blades is compatible with the objective that the outside surface of the blade is always in contact with the hole or casing longitudinally, thus maintaining maximum stand-off and reducing vibration during rotation. For this requirement to be achieved when the protector sleeve or centralizer is moving downhole, the space between the blades is equal to the width of the blades or smaller. Specifically, to maximize flow-by of fluids, the ratio of spacing between blades to blade width is about 1:1. Equation (2) provides the optimal number of blades to satisfy these criteria:

$$N=\pi(R_c+t+h)/w \qquad \text{Eq. (2):}$$

As an example, a spacing that is less than the width of the blades should not yield more than one or two additional blades compared with a sleeve having an equal number of blades and blade spacings. The objectives are to maintain constant stand-off, supply angle flow-by area and limit flow restrictions. In one embodiment, for a non-rotating sleeve according to this invention (a test unit referred to herein as US-500), $R_c$=2.5625 inches, t=0.75 inch, h=0.3375 inch, and w=1.16 inches, the test unit contained 10 blades. Blade width is based on material properties, and can vary, and the number of blades can vary, but is determined with the objective of maximizing blade number and minimizing pressure drop. In another embodiment, for a 9⅝ inch casing centralizer which would normally be run in a 12¼ inch hole, the centralizer would have an 11½ inch outer diameter, wall thickness (t)=0.5 inch, $R_c$=4.875 inches, t=0.75 inch, blade width (w)=1.5 inches, blade number (N)=12 and blade height=0.375 inch. Ideally, the number (N) is rounded to the nearest integer Empirical testing has been conducted with a test fixture that simulates drill pipe having a non-rotating protector (with internal fluid bearing surfaces) that rotates on drill pipe in casing filled with mud while sliding downhole with specified side loads. This testing has shown that the sleeve has a slow rotation during its movement downhole. For example, observation has shown for 5-inch diameter drill pipe in drilling mud in 9⅝ inch diameter casing, while sliding downhole and with the drill pipe rotating at 120 rpm, the sleeve of the non-rotating drill pipe protector will rotate approximately 4-6 revolutions per minute. That is, for approximately every 20-30 revolutions of the drill pipe the protector sleeve rotates one revolution. Therefore, for a casing centralizer or non-rotating drill pipe protector sleeve of this invention, a continuous contact can be produced between the sleeve and the casing or casing exit. With straight longitudinal blades, as the sleeve rotates, there is a discontinuous contact as the sleeve jumps between blades; this is observed empirically with audible sound and vibrations into the test fixture. Therefore, during sliding and rotating of drill pipe in casing, or casing with centralizer in casing, or open hole, a spiral shape of the blades is preferable, as it allows more continuous motion of the sleeve, thereby reducing casing or drill string vibration. And by reducing load variation on the casing centralizer or sleeve, wear life is increased and casing or drill string torque (seen at the surface) is reduced.

The spiral shape that is most efficient is driven by anticipated operating parameters. First, the angle between blade centers is a function of the number of blades. Secondly, when a blade has a constant pitch along its length relative to the sleeve or centralizer center axis, the spiral shape may be partially defined by the arc angle a blade makes along the length of the sleeve or centralizer. In order to maintain the objective of always having at least one blade contacting at maximum stand-off, the blade spacing and arc angle along its length (when at constant pitch) for the blades can be as shown in Equations (3) and (4):

$$\text{Angle between Blade Centers} = 360 \text{ degrees}/N \qquad \text{Eq. (3)}$$

$$\text{Arc Angle for Single Blade Along its length at Constant Pitch} = \frac{(360\ w)}{\pi(R_c + t + h)} \qquad \text{Eq. (4)}$$

For the example previously given for a 4.5-inch sleeve with 8 of the 0.275 inch high blades, the angle of the arc of the blades is about 22.5 degrees. The arc also must meet physical constraints of manufacturing, which includes the presence of one or more hinges in the centralizer or protector sleeve. Specifically, the hinges are located between blades, and are thereby protected from damage.

Figure 7:
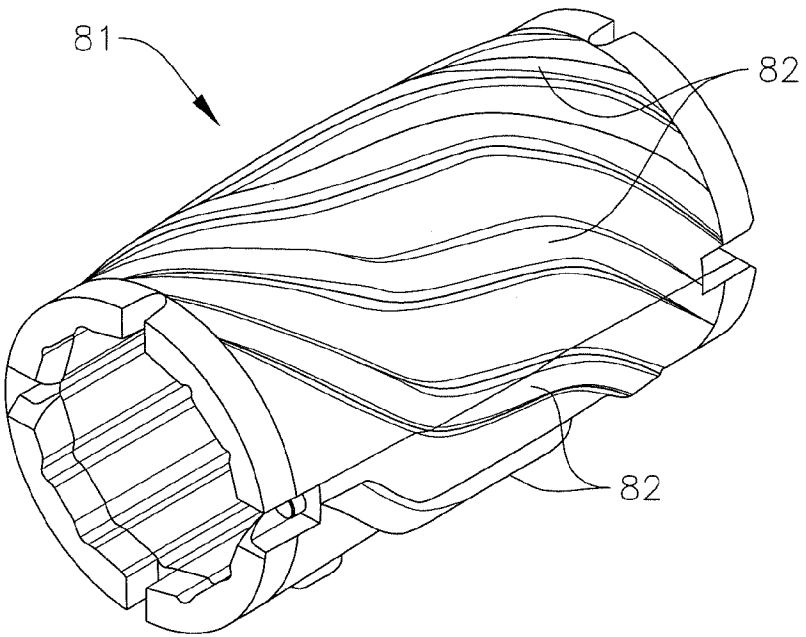
FIG. 7 is a perspective view showing an optimized casing centralizer or open hole non-rotating drill pipe protector sleeve with variable pitch blades.

Alternatively, it is advantageous to decrease the number of blades while maintaining a minimum of two blades in contact with the hole or formation. This can be accomplished by allowing a variable arc or pitch of the blades along their length. The advantages of smooth transition into and out of casing exits or shoes, and traversing into open hole without snagging, but maintaining large flow-by and reducing the Equivalent Circulation Density (ECD) can be achieved with this invention. FIG. 7 shows such an alternative embodiment comprising an optimized casing centralizer (or non-rotating drill pipe protector sleeve) 81 with variable pitch blades 82.

The blade construction also involves the manufacturing process for the sleeve or centralizer. For typically poured molding processes, the blades run longitudinally; because spiral blades can be difficult to remove from the mold after manufacturing. Longitudinal blades are more easily extracted with a vertical lift. However, compression molding of segments of the sleeve or centralizer allows use of curved and helical-shaped blades. Thus, a compression molding process facilitates use of the curved blades in this invention.

The length of the centralizer or sleeve is related to the amount of side load support required for the particular application and the anticipated wear life of the sleeve. For both the centralizer and protector sleeve, the ends will wear with use as the sleeve will be contacting the collar or coupling of the casing. The addition of length to accommodate wear is one consideration. The required length also is affected by the internal surface area, internal surface hardness, fluid viscosity, revolutions per minute, and distance between the centralizer and casing, or between the drill pipe protector sleeve and the drill pipe.

Further, the centralizer and protector sleeve incorporate the use of a fluid bearing on the interior of the centralizer or drill pipe protector sleeve. Referring to the embodiment in FIG. 6, the fluid bearing consists of specifically sized and spaced flat areas 74 running axially along the ID of the sleeve, with intermittent running axial (substantially longitudinally extending) grooves 72 between the flat surfaces. The flats 74 are of constant width along their length. The flats do not taper within or along the interior of the centralizer or sleeve. The interior surface can comprise a liner in which the interior surfaces of the flats are made of a material with low softness such as a thermoplastic elastomer or soft plastic. Preferred hardness of the liner is from approximately 55 Shore A to approximately 75 Shore A, more preferably, from about 60 to about 70 Shore A. The grooves 72 in the liner can have a circularly curved bottom and are approximately ⅛-inch in depth. (The grooves are of substantially uniform depth from end to end.) The curved bottoms allow debris or cuttings to pass through the casing centralizer or protector sleeve without creating an abrasive surface that could wear the casing or drill pipe. When the above geometry is properly applied, experiments have shown that a protector sleeve with a 10-inch length of flats and grooves can provide 1500-7000 lbs of side load without collapsing and also produce a rotational coefficient of friction of 0.03-0.05. (This is less than 10% of the coefficient of friction of steel casing on rock formation and less than 25% of the coefficient of friction of steel casing being run though a larger steel casing.) When applied in critical locations along the casing string or drill pipe, the above geometry can result in a torque reduction of 10-30% when rotating casing or drill pipe, and a torque reduction (drag) of 10-20% when sliding casing or drill pipe, compared to a typical well application without the use of protectors. This improvement can enhance the viability of reaching the target casing setting depth or drilling target depth, with the associated advantageous cost effects.

Alternatively, for the interior portion of the casing centralizer or drill pipe protector sleeve, a fluid bearing surface made of a polymeric material can be used. In one embodiment, a compression molded UHMW polyethylene interior can be used to form the fluid bearing. (In this instance the sleeve is of unitary construction with no separate liner.) In one embodiment, this construction is particularly useful for a casing centralizer. Because the hardness of the UHMWPE is generally greater than 55 or 60 Shore A, the capacity of the fluid bearing is reduced. However, upon overloading of the fluid bearing, that is, when the side loads are greater than the pressure gradient of the fluid bearing over its operational area, the low friction UHMW polyethylene allows a coefficient of friction of approximately 0.15 between the casing and casing centralizer or between the drill pipe and drill pipe protector sleeve. This design alternative is useful when side loads are not well defined, such as when the wellbore survey is done on 100-foot intervals in highly deviated formations. In this type of application the well curvature, the dog-leg severity, can be as much as 50% in error, so the additional overload capacity in the casing centralizer and protector sleeve is useful to tolerate unanticipated side loads.

As to fitting the centralizer or protector sleeve on the casing or drill pipe, the diametrical distance between the casing and of the ID of the centralizer, or between the ID of the sleeve and drill pipe, is not a clearance fit, or a close fit around the OD of the casing or drill pipe, either of which is typically used for a contact bearing design. Rather, the diametrical distance, according to this invention, allows the proper development of a fluid pressure profile that produces a fluid bearing function during use. For example, the diametrical distance (between the OD of the casing or drill pipe and the flats contained in the fluid bearing) is approximately 0.125-inch larger than the diameter of the 5-inch nominal casing or drill pipe. This, in combination with the axial grooves, produces the fluid bearing function.

The diameters of the sleeve at the ends are such that when the protector sleeve is offset against the drill pipe under loading, the sleeve ends on the opposing side of the load do not extend beyond the outer radius of the stop collar. For example, a sleeve for a 5-inch drill pipe has an ID of 5.125 inches. Taking this loose fit into consideration, the OD of the sleeve at the collar/sleeve interface should be 0.125 inch less than the OD of the collar. In other words, the designed additional diameter clearance for the ID of the sleeve should be that much less than the OD of the collar at the collar/sleeve interfaces. This can aid in creating a smooth transition of load from collar to sleeve.

Exiting a casing can be a difficult task for a centralizer or open hole protector, because of the sharp edge at the end of the casing; this edge can damage centralizers and open hole protectors by cutting or catching on surfaces during use. For drilling operations the rate of penetration can be 10-150 ft/hour, and for running casing can be about 100 feet/minute. Therefore, when traversing a casing exit, a one foot centralizer or NRDPP sleeve will experience its highest loads for only a few seconds, with the benefit of reducing the potential danger of damage.

The compressive strength and the shear strength of the material for the centralizer or sleeve are of importance in their influence on the exiting of casing. Specifically, the shear strength of the sleeve or centralizer determines the resistance to cutting of the sleeve. The longitudinal taper of the blades is determined by twice the blade width, the shear strength of the blade or centralizer, and the anticipated loads.

Also, the thickness of the casing centralizer body or protector sleeve depends upon the particular application. For example, for the casing centralizer, the centralizer body may be thin and comparable to the casing coupling thickness. For the protector sleeve assembly, the protector body may be relatively thicker to allow greater overall sleeve diameter for providing good standoff from the casing or hole, but retaining substantial ruggedness.

Figure 8A:
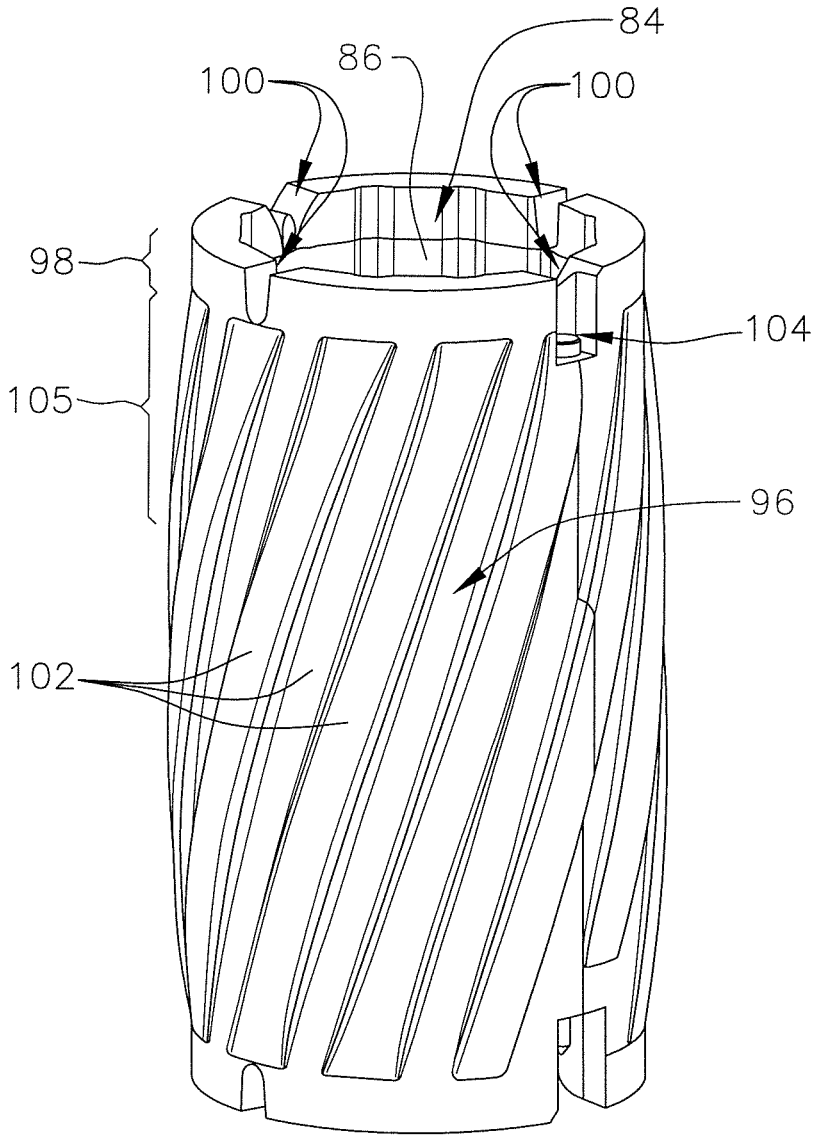
FIG. 8A is a perspective view showing an optimized open hole non-rotating drill pipe protector sleeve.
Figure 8B:
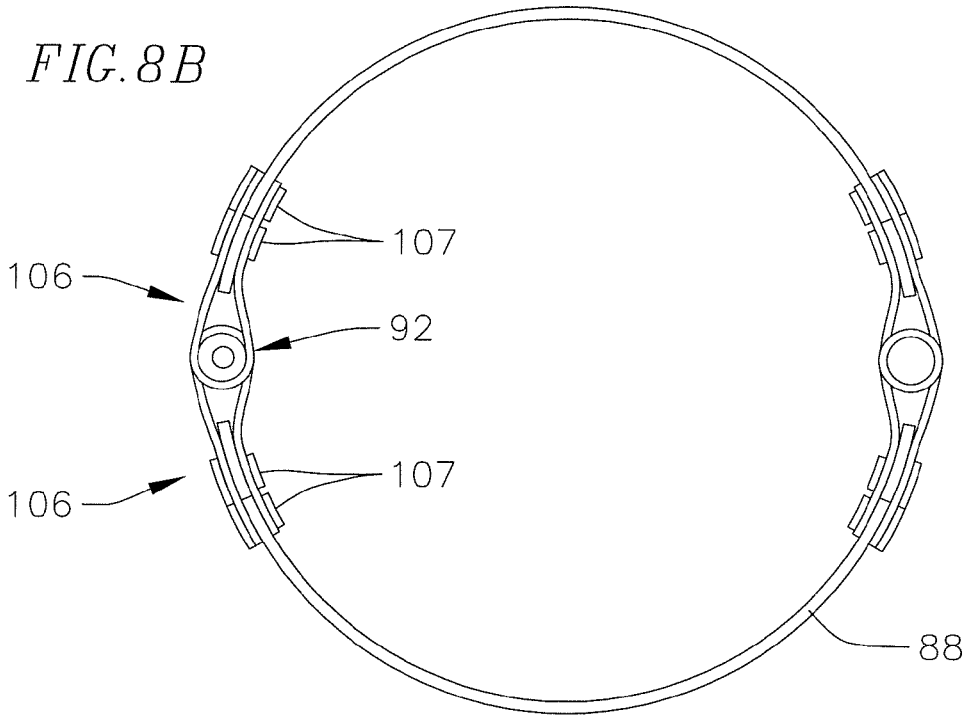
FIG. 8B is an elevational view showing an optimal cage hinge design.
Figure 8C:
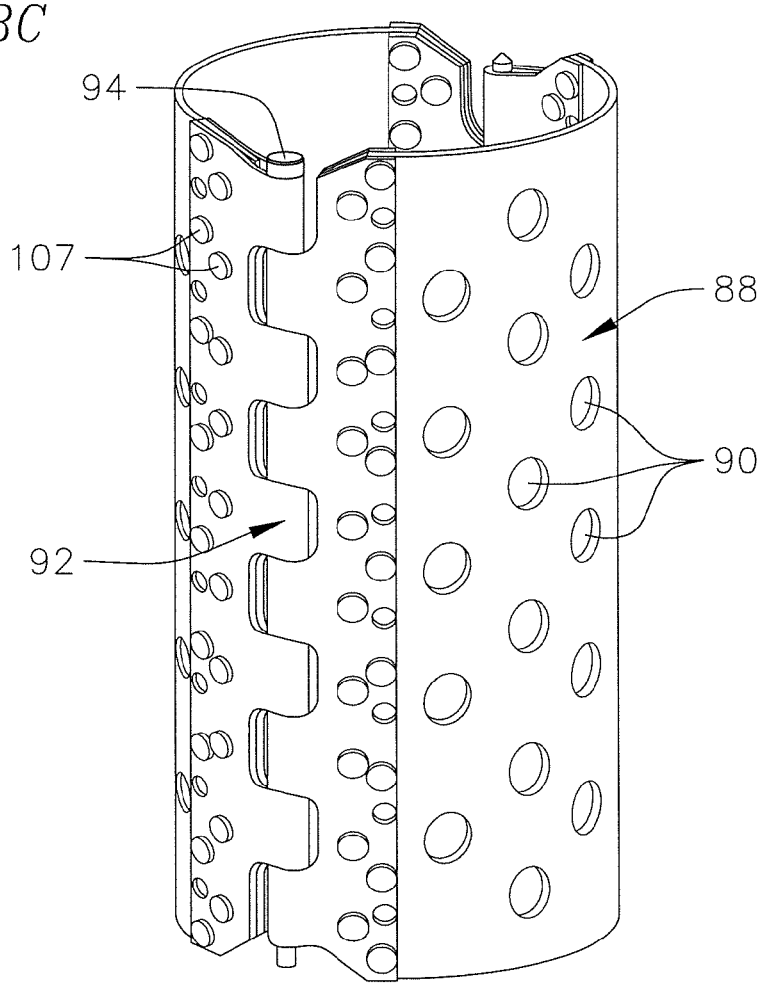
FIG. 8C is a perspective view showing a reinforcing cage for the protector sleeve.

(e) Non-Rotating Drill Pipe Protector Sleeve Features: Referring to FIGS. 8A-8C, the open hole NRDPP sleeve construction includes the following features for optimal performance and operation:

(1) Internal fluid bearing 84 formed as an internal liner, with multiple rectangular (non-tapered) flats 86 consisting of a soft material (such as rubber, or soft urethane). The fluid bearing surface has a hardness less than the hardness of the outer sleeve.

(2) Internal cage reinforcement 88 of steel with multiple perforations 90 to allow the sleeve material to communicate to both sides of the cage. The cage is preferably made from stainless steel having a minimum thickness of about 0.065 to 0.07 inch. In one embodiment, the cage is made from heat treatable 0.075-inch thick 4-10 stainless steel. The use of this material allows heat treating of the cage to a higher strength than an alloy steel cage used in a prior art sleeve (referred to as SS-500 and described in the Example test data below). Use of this material provides significant improvements in axial load capacity, i.e., increased compressive strength to failure and increased fatigue life. In addition, the thicker cage material, compared to the SS-500 use of 0.040 inch alloy steel, accommodates greater loads, as illustrated below.

(3) At least one hinge 92 with associated pin(s) 94, each hinge made of high strength steel or stainless steel. In one embodiment, the hinge material comprises the 0.075-inch, 4-10 stainless steel.

(4) Molded body 96 of a polymeric material, preferably compression molded Ultra High Molecular Weight Polyethylene.

(5) Extended length 98 at sleeve ends to increase wear life.

(6) Ports 100 at ends of sleeve to flush debris, aid in cooling, and help maintain fluid bearing while rotating.

(7) Optimal number and orientation of helical blades 102 (described previously).

(8) Low profile pin 104 with retaining feature, such as an O-ring or circumferential detent spring.

(9) Shallow taper on blades at 105 leading up to blade contact region, preferably less than 20 degrees.

(10) Optimal cage hinge construction 106 (teardrop profile hinge) to reduce fatigue when under load. Each hinge wraps around the edge of the cage and is affixed to the cage by rivets 107. This hinge design functions under load in pure tension, which reduces bending stress when loaded, compared with the prior art SS-500 hinge design.

(f) Material Properties: The invention preferably uses an ultra high molecular weight polyethylene (UHMWPE) for the sleeve or centralizer material. The UHMWPE comprises a long chain polyethylene with molecular weights usually between 2 million and 6 million, with "n" in the chemical structure (below) greater than 100,000 monomer units per molecule.

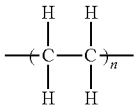

Polyethylene chemical structure.

The long chain length and fully saturated chemistry imparts unique properties to the desired UHMWPE, including resistance to swelling or degradation in water or hydrocarbons such as petroleum-based drilling fluids. The UHMWPE also has long wearing and low friction properties, similar to that of polytetrafluoroethylene (PTFE) or Teflon, except with greater strength and wear life. The UHMWPE also provides these performance benefits with a relatively low materials cost. In one embodiment, the preferred UHMWPE material has a Shore hardness of at least 40 Shore D, more preferably 50 Shore D, which provides improved load strength and stiffness during use. The UHMWPE also has significantly lower COF (approximately 0.12 for the US-500 drill pipe protector sleeve described in the Example below) versus 0.25-0.30 for the prior art polyurethane sleeve (referred to as SS-500) when sliding on steel in drilling fluid.

Because of the chemistry and long chain structure, the UHMWPE does not melt and flow like traditional thermoplastics, so it is not injection molded. It also cannot be cast like some nylons, or other thermoset plastics like epoxy, polyester, or polyurethane resins. Instead, the UHMWPE is compression molded or ram-extruded. The compression molding allows for intricate near-net shape and dimension finished parts, including complex designs such as the helical shaped blades on the outside of the protector sleeve and centralizer structures. Also, because the UHMWPE is compression molded from a powdered base material, the base polymer can be modified using additives such as heat and UV stabilizers, friction reduction agents, and fiber reinforcements. Fiber reinforcements can include glass, polyethylene fibers (such as Dyneema or Spectra), polyamide/polyimide fibers such as Kevlar, and carbon fibers. These additives can be used individually or collectively to modify and improve strength, rigidity, wear, friction, and high temperature properties, without having to remake or modify the production tooling. Also, the UHMWPE can be cross-linked through the use of high energy radiation, which can be used to alter the chemical structure, creating additional bonds between chains to provide additional wear resistance and higher temperature performance.

Because the UHMWPE is subjected to compression molding, the process facilitates the manufacture of molded rubber (elastomeric) inserts for an improved fluid bearing. Specifically, the elastomer can be pre-molded and partially cured in preparation for sleeve or centralizer manufacture. When the UHMWPE is molded (with heat and temperature) the process facilitates curing of the rubber and creation of a strong chemical bond between the UHMWPE and the rubber. Hence, the final molding process produces a finished product with a strong adhesive bond between components, producing a stronger and more rugged product.

All of the above-mentioned properties and manufacturing methods result in the UHMWPE providing a nearly optimum combination of properties for use in the casing centralizer and non-rotating protector designs.

Figure 9:
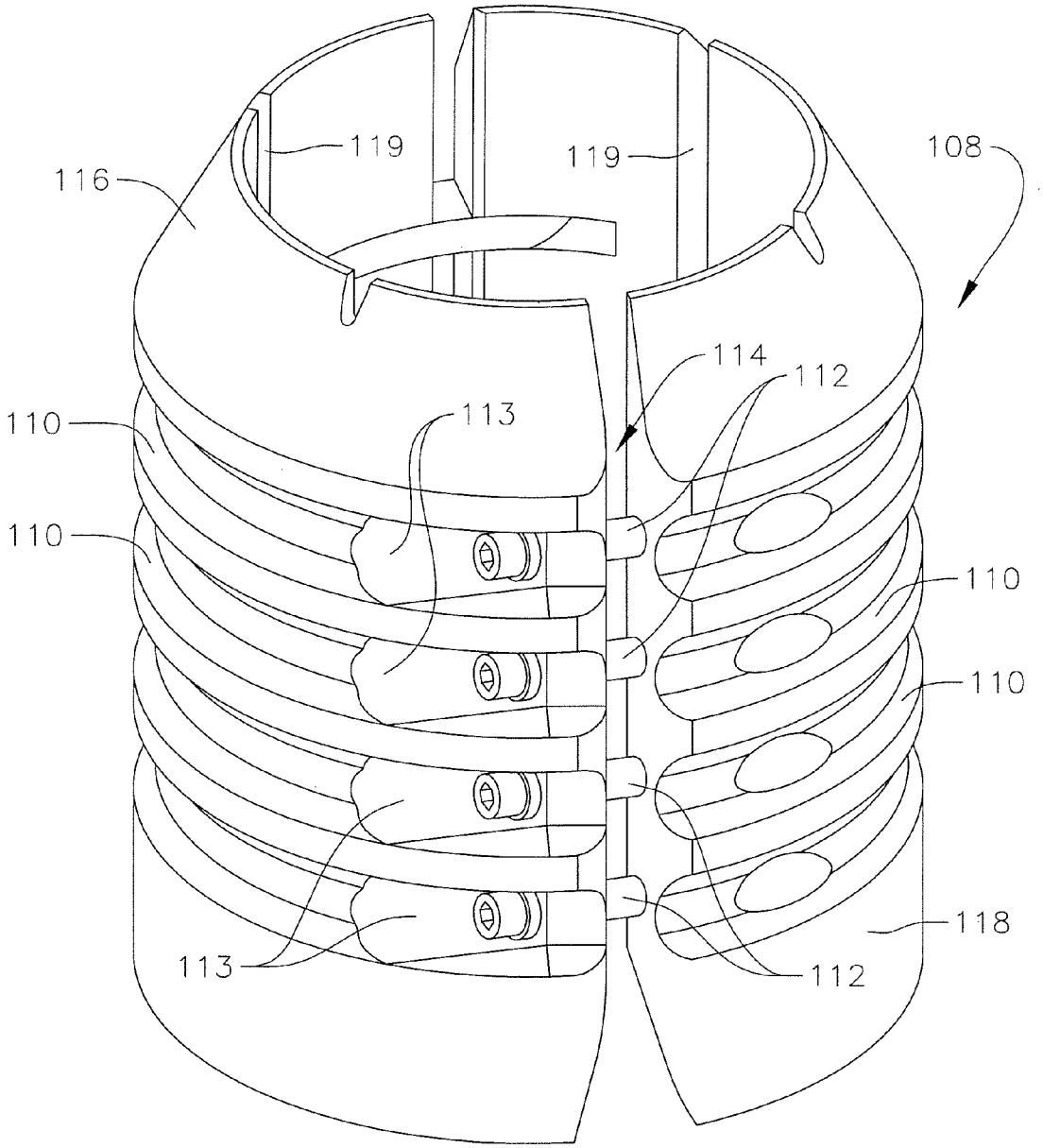
FIG. 9 is a perspective view showing an open hole drill pipe protector stop collar assembly.

(g) Collar Design: FIG. 9 illustrates one embodiment of a collar 108 for the open hole non-rotating drill pipe protector sleeve. The collar provides the following functions:

(1) It carries axial loading from drill pipe through the protectors to the casing or wellbore. It is capable of withstanding high axial loads before slipping or damage.

(2) It is easy and quick to install to reduce any non-productive time on the drilling rig.

(3) It is drillable in the event that a collar is lost downhole.

(4) The collar protects and provides a leading edge for the sleeve, and also protects the critical structural components of the collar (5) The collar provides a wear surface to allow the sleeve to rotate against the collar for a prolonged period of time without compromising the function of the collar or sleeve.

(6) The collar is strong enough to transmit the necessary axial loading and yet is flexible enough to allow the drill pipe to bend without causing excessive bending stress concentrations within the drill pipe.

FIG. 9 shows the preferred embodiment of the collar 108. To achieve the above combination of functions, the collar 108 has several features:

(a) The exterior of the collar has a circumferentially raised geometry which can include raised circumferential parallel ridges 110 spaced apart axially around the collar. The ridges protect the sleeve and bolts 112 while reducing the longitudinal stiffness of the collar. The bolts 112 are contained within recessed regions 113 to engage recessed threaded fittings (not shown) on the opposite side of a hinged axis 114.

(b) The collar has a shallow conceal taper 116 along its leading edge for allowing the drill pipe and protector to ride over obstructions with minimal axial loading transferred to the protector.

(c) The collar has a sacrificial wear surface 118 along the bottom section of the collar.

(d) The collar is hinged along the upright axis 114. The bolts 112 that allow for quick and easy installation and removal.

(e) The ID of the collar contains circumferentially spaced apart axially extending flex grooves 119 that improve upon rigidly securing the collar to the drill pipe or casing OD.

Figure 10:
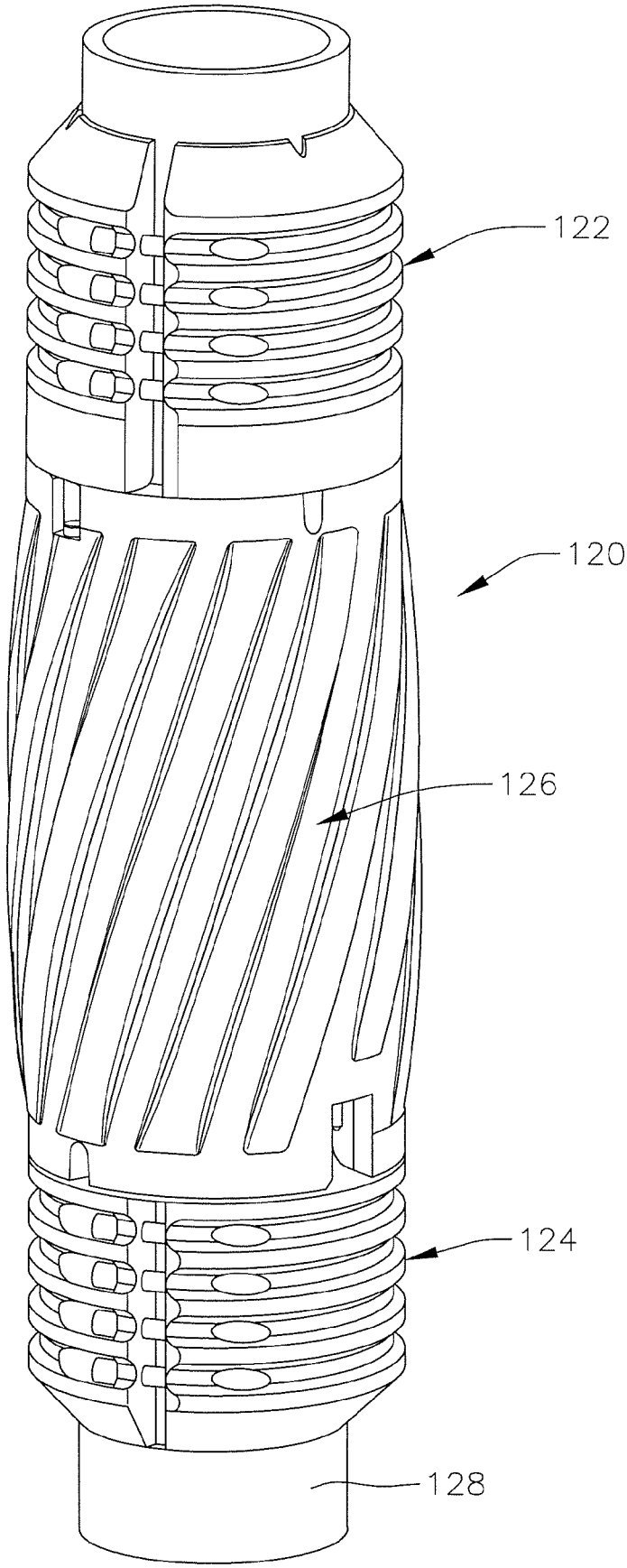
FIG. 10 is a perspective view showing an open hole drill pipe protector assembly on a drill pipe segment.

(h) Open Hole Non-Rotating Drill Pipe Protector Assembly: The various design features described above are implemented into the components of a collar and sleeve for an open hole non-rotating drill pipe protector assembly. FIG. 10 shows one embodiment of an open hole non-rotating drill pipe protector assembly 120 having upper and lower stop collars 122 and 124 (similar to the collar 108 described previously) and a drill pipe protector sleeve 126 (similar to the sleeve 96 described previously) installed on a section of a drill pipe 128.

Figure 12:
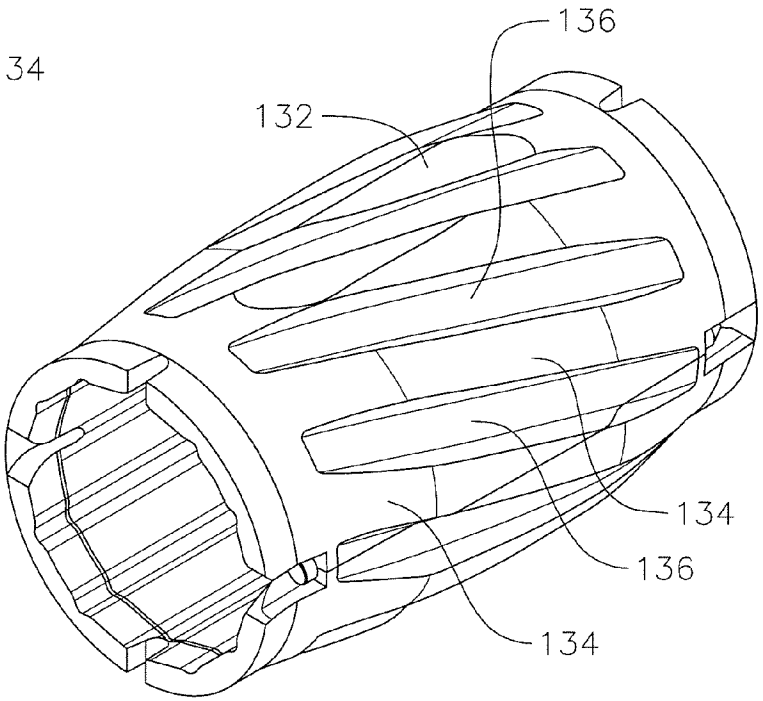
FIG. 12 is a perspective view of the sleeve shown in FIG. 11.
Figure 11:
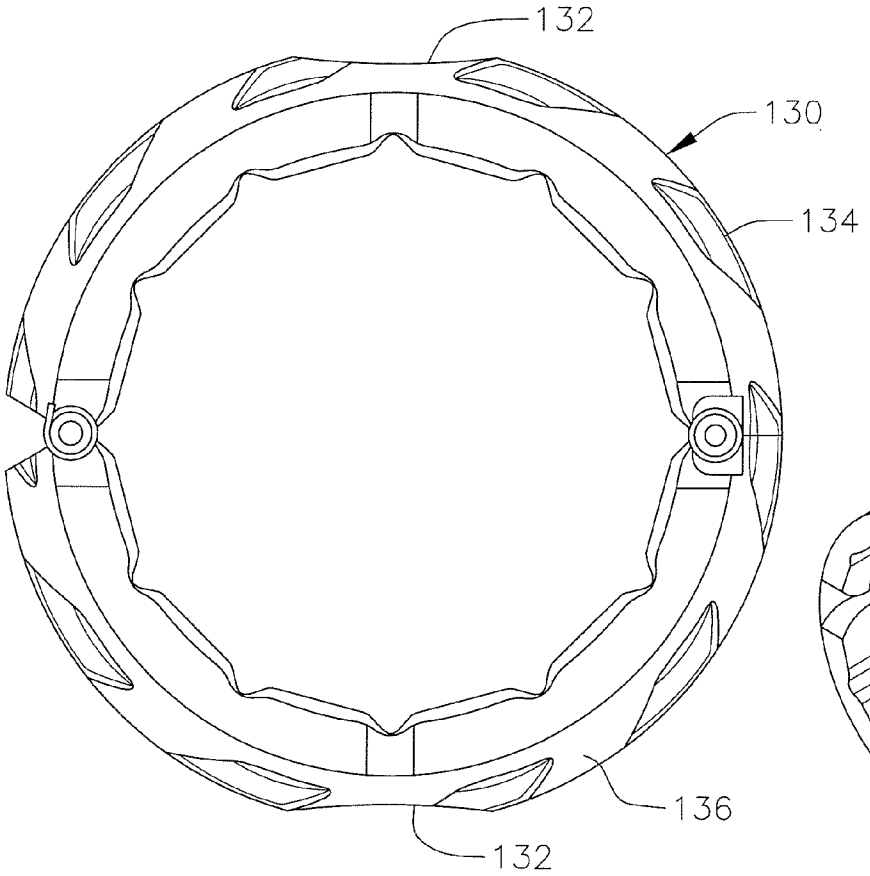
FIG. 11 is a cross-sectional view showing the internal configuration and axial grooves contained in a non-rotating protector sleeve.

(i) Anti-Spin Feature: As described previously, the non-rotating protector sleeve uses an internal geometry and softer inner surface to create a low friction fluid bearing while the drill pipe or casing is rotating. The low durometer inner surface may be made of a material having a higher coefficient of friction (COF) than the low-friction body of the sleeve. Upon initial rotation, frictional resistance between the tubular pipe or casing and sleeve inner surface may be greater than the resistance between the low friction exterior of the sleeve and wellbore. This can cause the protector sleeve to rotate. FIGS. 11 and 12 illustrate an anti-spin feature incorporated into a drill pipe protector sleeve 130. To aid the protector in functioning optimally, one or more axial grooves 132 may be incorporated in the OD surface of the sleeve to provide mechanical resistance to ensure that the protector will not rotate. The grooves 132 are sufficiently wide to create a reacting force great enough to react against a rotating tubular on the interior of the sleeve. The grooves 132 are formed in the OD of the sleeve in addition to the helical grooves 134 between adjacent helical blades 136. The formula to calculate the minimum groove width that will prevent rotation of the sleeve upon initial tubular rotation is shown in Equation (5):

$$W_{min}=2(COF_i*r-COF_o*R) \quad \text{Eq. (5):}$$

where, =Minimum Groove Width, r=Timer Radius, R=Outer Radius, $COF_i$=Inner Surface COF, and $COF_o$=Outer Surface COF.

Figure 13:
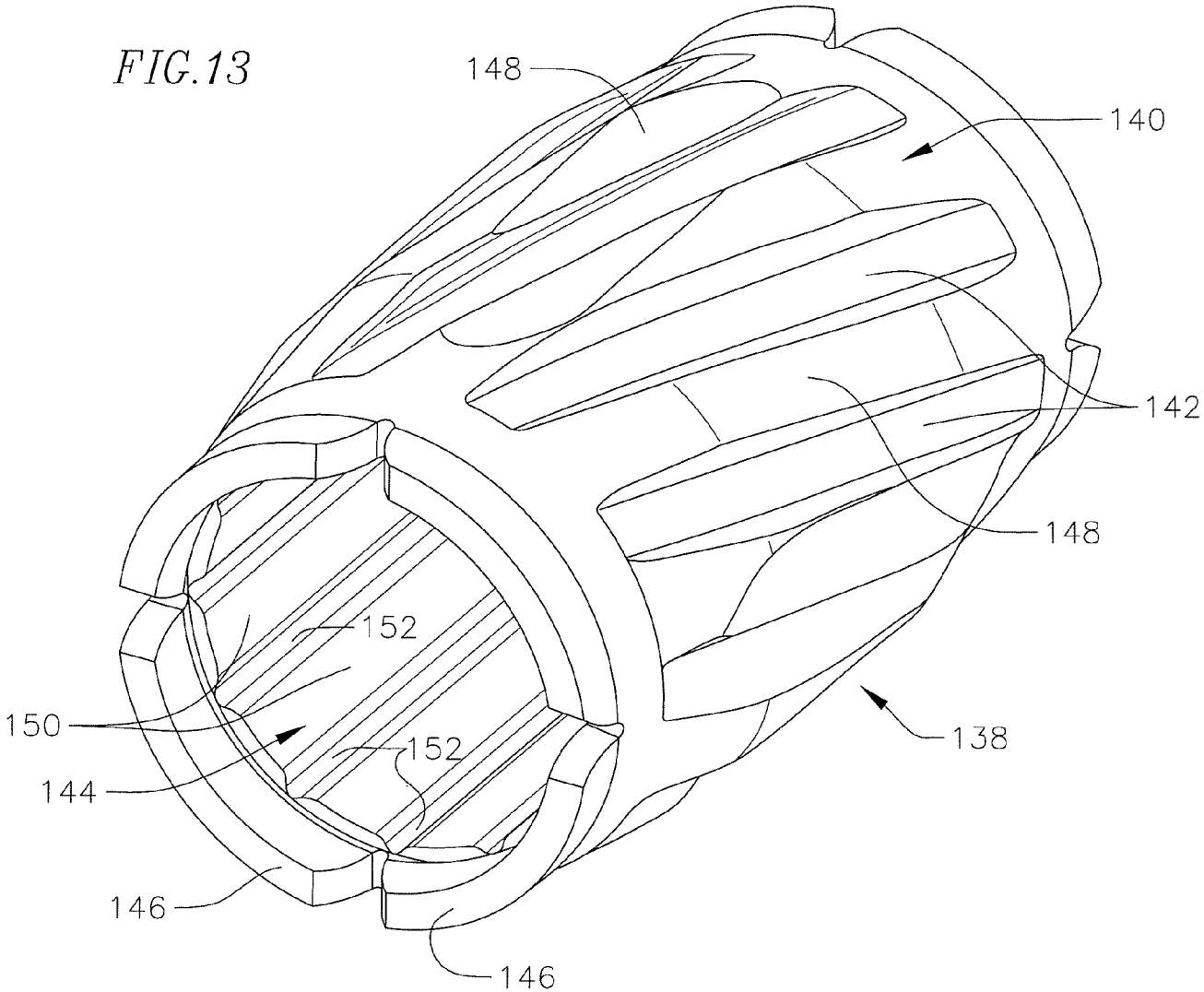
FIG. 13 is a perspective view illustrating end-cap, blade and liner materials used in a casing centralizer.
Figure 14:
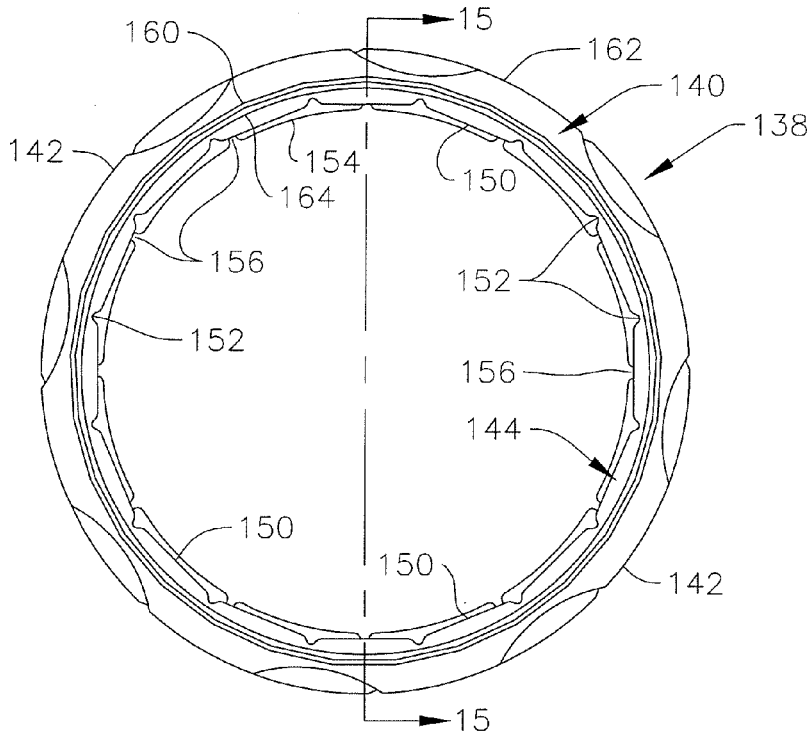
FIG. 14 is a cross-sectional view of a centralizer assembly which includes the centralizer of FIG. 13.
Figure 15:
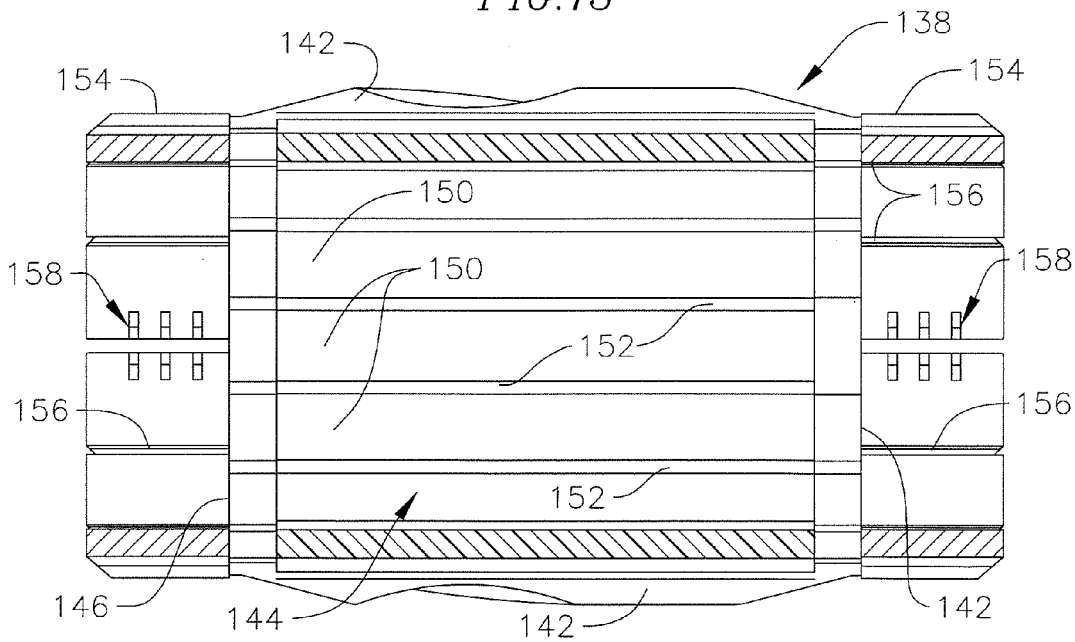
FIG. 15 is a longitudinal cross-sectional view taken on line 15-15 of FIG. 14.

(j) Blade and End-Cap Materials: When considering the different types of loading on each surface of the casing centralizer, a specific material can be chosen for each type of wear experienced on the various surfaces. FIGS. 13 to 15 show a centralizer assembly 138 which includes the centralizer body 140, the raised helical blades 142, the inner liner 144 which forms the fluid bearing, and the end-cap segments 146. The anti-spin grooved OD sections are shown at 148. The internal flats 150 for the fluid bearing are shown on the inner liner, and the axial grooves 152 are shown between the flat bearing sections of the liner.

As shown best in FIGS. 14 and 15, the casing centralizer assembly 138 includes stop collars 154 at opposite ends of the centralizer body. Each stop collar includes circumferentially spaced apart, axially extending stop collar flex grooves 156 extending parallel to one another along the ID of the collar.

The stop collar hinges are shown at 158. In the illustrated embodiment a continuous (non-hinged) cylindrical structural sleeve reinforcement 160 is embedded in the sleeve body between its OD surface 162 and its ID surface 164. The liner 144 for the fluid bearing inner surface is shown bonded to the ID surface 164 in FIG. 15. The non-hinged continuous centralizer embodiment can be used when drilling with casing, when running casing downhole, or when centralizing casing in a barehole during cementing operations.

A low durometer inner liner is used for creating a fluid bearing and thus reducing wear caused by rotation of the drill pipe or casing. For the inner liner, the material can be soft rubber, soft urethane, or similar low hardness plastic. A hard and smooth material is desired for the centralizer end cap wear surface that meets the collar assembly and provides gradual mechanical wear. For the end cap materials, a hard plastic and low friction polymeric material, such as Ultra High Molecular Weight Polyethylene, is an appropriate material. Alternatively, the inner liner and end pieces can be made from a poured polymeric material, such as a polyurethane of soft to medium hardness. In this embodiment, the urethane can be poured over the body of the sleeve or centralizer, thus providing the inner liner, and over the ends contacting the casing collar or stop collar, and also over the blades and grooves between the blades, thus helping to hold the plastic coating in place. In addition, holes may be placed on the ends of the body to allow the plastic coating to flow or be pressed into place, providing a means to additionally bond the end pads and/or liner. The end pads are sized to make contact with the casing coupling that acts as a stop for the unit when running the tubular downhole.

The raised blades of the casing centralizer which contact the wellbore casing and open-hole formations are preferably made of a smooth yet tough material, which is less prone to fracturing. In one embodiment, the blades or blade components are made of metal with or without hard-facing for increased toughness. Various types of hard-facing include tungsten carbide that is flame sprayed or applied as individual inserts. Other coatings include high wear resistance ceramics that are sprayed or used as inserts. In another embodiment, the blades are coated with a tough low friction material such as Ultra High Molecular Weight Polyethylene. The blades are of a size and shape to reduce the pressure drop across the centralizer when cement or drilling mud passes the centralizer on its path downhole, thus reducing the risk for formation damage.

Further, in this embodiment, the body of the centralizer or sleeve may be made of metal including, but not limited to, steel, zinc, or aluminum. Further, the metal body may be rolled and welded, cast, forged and machined, or by other metal processing. The thickness of the body is determined primarily by the anticipated axial load, which can be 5,000-50,000 pounds per centralizer. Further, the body may be made entirely of a stiff plastic, such as a phenolic or similar hard plastic, or reinforced plastic, or an elastomeric material. The body may be equipped with or without a hinge for installation; use of a hinge allows installation on the rig floor. Although installation without a hinge can be slower, it offers the benefit of reduced cost and increased structural strength. Depending upon the material used in the body of the centralizer or sleeve, and its relative coefficient of friction to casing or formation, the body's external surface may have anti-rotation grooves if the sleeve body has a low coefficient of friction. Alternatively, the anti-rotation axial grooves will not be necessary with sleeve body materials having a COF greater than approximately 0.12.

Thus, the casing centralizer of this invention provides the following benefits for running casing: (1) torque reduction when rotating casing into the hole or with casing drilling, (2) drag reduction and thus allows greater lengths of casing to be placed into the hole, (3) improved cement jobs as the casing is centered in the hole and allows cement to completely surround the casing, thus increasing well pressure integrity, and (4) buckling load increase with proper placement, thus allowing greater lengths of casing to be run and with greater safety.

EXAMPLE

Performance testing was conducted with a test fixture that simulates performance in downhole environments. Testing conducted with the test fixture compared performance of the sleeve of this invention with a prior art drill pipe protector sleeve. Performance testing also was compared between the invention and a drill pipe tool joint operated in the absence of a drill pipe protector sleeve.

The test fixture tested performance of a sleeve on a drill pipe that rotated in a casing filled with mud while sliding downhole with specified side loads, with the drill pipe rotating at 120 rpm. A cement liner was used to simulate friction that develops in an open hole drilling environment.

Sliding COF (when sliding and rotating) and rotating COF (when sliding and rotating) were measured to compare performance (torque and drag reduction) of a sleeve corresponding to this invention (referred to as US-500) with a prior art drill pipe protector sleeve (referred to as SS-500). Test conditions were identical: same test fixture, load, rpm, and drilling fluid.

A 5-inch diameter drill pipe was rotated on the interior of the US-500 sleeve during testing. The effective ID of the sleeve was 5.125 inches. The sleeve contained 10 helical blades on the outer sliding surface and was made of compression molded UHMWPE with a non-rotating fluid bearing liner made of Nitrile Butadiene Rubber (NBR) having a Shore A hardness of 70-75. The hardness of the molded UHMWPE sleeve was 50 Shore D. The SS-500 sleeve was tested in the same manner. This sleeve was made of molded polyurethane with a much lower hardness (92 Shore A). The sleeve contained no helical blades but rather axial OD grooves, UHMWPE inserts on the exterior sliding surfaces, and a fluid bearing liner of NBR with a Shore A hardness of 60-70. Each test sleeve contained an internal reinforcing cage and hinged structure, although the US-500 test unit contained two hinge structures and the SS-500 test unit was hinged along one side. The US-500 test unit contained the improved internal cage structure (described previously) with the cage body thickness of 0.075 inch heat treatable stainless steel. The SS-500 test unit's cage body thickness was 0.040 inch heat treatable alloy steel. The US-500 test unit contained the improved hinge design (described previously). The SS-500 test unit contained a prior art eyelet design. Both sleeves were tested with stop collars at both ends of the sleeve.

Sliding COF was measured between the outside surface of the sleeve and the wellbore (casing or open hole). This is a mathematical calculation of axial friction divided by radial load.

Rotating COF was a measure of cumulative friction due to rotation: the sum of the friction at the pipe body and drill pipe protector sleeve interior interface and at the stop collar and drill pipe protector interface.

The comparative test data were as follows for rotating and sliding in a cased hole environment:

| | SS-500 | US-500 |
|---|---|---|
| Sliding COF | 0.19 | 0.05 |
| Rotating COF | 0.10 | 0.08 |

In summary, the test data showed a 70% improvement in torque reduction in sliding friction and a 20% improvement in torque reduction for rotating COF for the US-500 test unit compared to the prior art SS-500 test unit.

In a similar test comparing the US-500 sleeve with a tool joint with casing-friendly hard-banding, the US-500 test unit experienced a 76% torque reduction in cased hole and an 69% torque reduction with a cement liner.

Sleeve compression tests carried out on the test fixture measured axial compressive loading versus displacement to compare the test sleeves' resistance to compressive failure. Test results showed an average failure at compressive loading of 28,000 lbs for the SS-500 test unit and 45,000 lbs for the US-500 test unit, a 61% increase in axial load capacity.

Field tests have indicated that end wear for the US-500 sleeve is lower, when compared with the SS-500 sleeve.

(k) Summary Of Open Hole Non-Rotating Drill Pipe Protector Sleeve And Casing Centralizer: The following summarizes some of the features of the open hole non-rotating drill pipe protector sleeve and casing centralizer:

1) Materials: The NRDPP sleeve or centralizer blades are constructed primarily of compression molded Ultra High Molecular Weight Polyethylene (UHMW) with metal (preferably steel reinforcement) and a soft inner liner (preferably of elastomer or low hardness plastic) that is molded and bonded to the tubular body of the sleeve or centralizer. In addition, a reinforcement is bonded into the sleeve or centralizer. The reinforcement is made of steel or stainless steel.

(2) Fluid Bearing: The inner surface of the sleeve or liner is designed with non-tapering flats and axially running grooves and the inner surface is made of soft material, such as elastomer, to allow the development of a fluid bearing over a range of drill pipe or casing rotations from 10 rpm and greater.

(3) Inner Liner Attachment: The inner liner may be chemically bonded or mechanically bonded or both to the body of the sleeve or centralizer.

(4) Sleeve/Centralizer Blade Number: The number of blades is optimized to allow the following:

a. Minimum of two blades to contact the hole at a casing exit both circumferentially and longitudinally.

b. Maintain maximum stand-off and reduced vibration while rotating.

c. Maximize the fluid flow past the sleeve.

(5) Blade Width: The blade width is optimized to allow maximum support and to resist cutting or shearing to the minimum of two blades on the sleeve when sliding across sharp surfaces.

(6) Sleeve Profile: The sleeve/casing centralizer is optimized to resist damage when traversing sharp as well as provide uniform contact when sliding on smooth surfaces. This can be achieved by the preferred embodiment of a long taper, which provides both the resistance to cutting on edges and helps the fluid bearing remain uniformly loaded.

(7) Overall Sleeve Assembly: When rapid installation on drill pipe is required, the sleeve is equipped with hinges and pins. The pins are specially design to resist movement out of the hinge. Alternatively, when installing on casing hinges may or may not be incorporated depending upon field installation requirement, such as installation in the pipe yard of the centralizer or installation when running casing in the hole. The assembly for drill pipe protectors will typically use a specially designed collar to hold it in the desired location on the drill string. For the casing centralizer, the various types of collars may or may not be used to hold the collar in a specific location on the casing.

(8) Collar Assemblies: Collar assemblies are specially designed to provide substantial protection of the sleeve, thus helping to prevent damage to the sleeve or centralizer when traversing casing exits, casing shoes, or downhole debris. The collar assemblies are specially equipped with stress relieved sections to allow flexure of the collar. This feature lowers stress in the drill pipe or casing and thus the collar does not degrade fatigue life of the casings or drill pipe.

(9) Combinations of Design Features: The design uses a combination of one or more of these features in an embodiment for the NRDPP or casing centralizers.

In summary, the design features for the casing centralizer as described herein are also applicable to an open hole drill pipe protector sleeve, and vice versa.

What is claimed is:

1. A non-rotating casing centralizer adapted for use with a casing disposed in a borehole, the casing centralizer comprising:

a tubular sleeve made from a molded polymeric material and having an inside surface adapted to surround a section of casing, the inside surface of the sleeve having circumferentially spaced apart axially extending grooves positioned between substantially flat bearing surface regions for contacting the outer surface of the casing, the axial grooves allowing fluid to circulate therethrough to form a non-rotating fluid bearing upon circulation of fluid under pressure between the inside surface of the sleeve and the casing, characterized in that:

the tubular sleeve has a plurality of helical blades integrally formed with the polymeric tubular body and projecting from an outer surface of the sleeve, the helical blades having outer surfaces adapted for contact with the borehole, the helical blades providing a flow path for fluid passing between the blades, the flow path passing through the borehole between upper and lower ends of the tubular sleeve, the tubular sleeve comprising a continuous non-hinged wall structure for surrounding the casing, a metal cage embedded in and circumferentially encircling the tubular body of the sleeve, to reinforce the continuous wall structure of the sleeve; and in which the helical blades have a blade height (h) and an average blade width (w) such that, during rotating and sliding motion of the sleeve in the wellbore, a minimum of two blades are positioned to maintain contact with the wellbore;

wherein the number (N) of blades on the tubular body is equal to:

$$N=\pi(R_c+t+h)/w$$

wherein:

$R_c$=sleeve radius t=sleeve thickness h=blade height w=average blade width wherein the number (N) is rounded to the nearest integer.

2. The casing centralizer according to claim 1 in which the tubular sleeve comprises an interior liner forming the flat surface regions and axial grooves of said fluid bearing, and a tubular outer section made from said molded polymeric material integrally formed with the helical blades, the inner liner bonded to the tubular outer section, the inner liner having a hardness less than the hardness of the tubular outer section.

3. The casing centralizer according to claim 2 in which the inner liner is made from a thermoplastic elastomer, soft plastic, or rubber-containing material having a Shore A hardness from about 55 to about 75, and the tubular outer section is made from ultra high molecular weight polyethylene.

4. The casing centralizer according to claim 1 in which the tubular sleeve comprises a molded polymeric material, and in which the reinforcing cage structure is made from heat-treatable steel having a thickness of at least about 0.065 inch; in which the molded tubular centralizer sleeve comprises ultra high molecular weight polyethylene, and in which the centralizer has an average compressive loading resistance of at least about 40,000 pounds.

5. The casing centralizer according to claim 1 in which the tubular body of the sleeve comprises a solid body made of compression molded ultra high molecular weight polyethylene, and in which the centralizer sleeve has a sliding COF and a rotating COF of 0.10 or less.

6. The casing centralizer according to claim 1 in which the helical blades extend generally parallel to one another with intervening parallel and helical spacing, the spacing having (a) or (b):

(a) an average width substantially equal to no more than the average blade width (w);

(b) an average width between blades which is substantially equal to the average width (w) of the helical blades.

7. A casing centralizer assembly which includes the non-rotating centralizer sleeve according to claim 1 installed on a section of casing disposed in a borehole, and including at least one stop collar rigidly affixed to the casing adjacent the centralizer, the blades of the centralizer adapted for contact with the borehole.

8. The assembly of claim 7 in which the casing includes (a) or (b):

(a) a drill bit for drilling the borehole;

(b) a downhole tool for landing in the borehole via the casing.

9. The casing centralizer according to claim 1 in which the helical blades have an arc angle equal to:

$$\frac{(360\ w)}{\pi(R_c + t + h)}.$$

10. The casing centralizer according to claim 1 in which:

(a) the sleeve is made from ultra high molecular weight polyethylene, (b) the sleeve includes a heat treatable steel cage having a thickness of at least about 0.065 inch, and (c) the blades extend generally parallel to one another with generally uniform spacing between them.

11. A method of reducing torque when drilling with a casing in a borehole formed in an underground formation, the method including drilling the borehole with a section of casing, the casing having installed thereon at least one non-rotating centralizer having a tubular sleeve made from a molded polymeric material and disposed around the casing, the inside surface of the sleeve having a combination of axial grooves and substantially flat intervening axial regions forming a non-rotating fluid bearing around the casing, the tubular sleeve having a plurality of helical blades integrally formed with and projecting from the outer surface of the sleeve, the tubular sleeve comprising a continuous non-hinged wall structure for surrounding the casing, and a metal cage embedded in and circumferentially encircling the tubular body of the sleeve, characterized in that the method includes drilling with the casing while circulating fluid through the borehole, the axial grooves of the sleeve inner surface allowing drilling fluid to circulate therethrough to provide a non-rotating fluid bearing between the centralizer and the casing, the helical blades having outer surfaces adapted to contact the borehole while providing a flow path through the borehole between the helical blades, in which the helical blades have a blade height (h) and an average blade width (w) such that, during rotation and sliding motion of the sleeve in the wellbore, a minimum of two blades are positioned to maintain contact with the wellbore;

wherein the number (N) of blades on the tubular sleeve is equal to:

$$N=\pi(R_c+t+h)/w$$

wherein:

$R_c$=sleeve radius t=sleeve thickness h=blade height w=average blade width.

wherein the number (N) is rounded to the nearest integer.

12. The method according to claim 11 in which the centralizer is made of ultra high molecular weight polyethylene, and in which the centralizer sleeve has a sliding COF and a rotating COF of 0.10 or less.

13. The method according to claim 11 in which the tubular sleeve comprises an interior liner forming the flat surface regions and axial grooves of said fluid bearing, and a tubular outer section made from said molded polymeric material integrally formed with the helical blades, the inner liner bonded to the tubular outer section, the inner liner having a hardness less than the hardness of the tubular outer section, in which the inner liner is made from a thermoplastic elastomer, soft plastic, or rubber-containing material having a Shore A hardness from about 55 to about 75, and the tubular outer section is made of ultra high molecular weight polyethylene.

14. The method according to claim 11 in which the tubular body comprises a molded polymeric material, and in which the reinforcing cage structure is made from heat-treatable steel having a thickness of at least about 0.065 inch; and in which the centralizer has a resistance to axial loading of at least about 40,000 pounds.

15. The method according to claim 11 in which the blades have a generally parallel and helical spacing having an average width (w) between blades which is substantially equal to the average width of the helical blades.

16. The method according to claim 11 in which the helical blades have an arc angle equal to:

$$\frac{(360\ w)}{\pi(R_c + t + h)}.$$

17. The method according to claim 11 in which:

(a) the sleeve is made from ultra high molecular weight polyethylene, (b) the sleeve includes a heat treatable steel cage having a thickness of at least about 0.065 inch, and (c) the blades extend generally parallel to one another with generally uniform spacing between them.

18. The method according to claim 11 in which the tubular body of the sleeve comprises a solid body made of compression molded ultra high molecular weight polyethylene.

* * * * *

UNITED STATES PATENT AND TRADEMARK OFFICE

CERTIFICATE OF CORRECTION

PATENT NO. : 8,668,007 B2
APPLICATION NO. : 12/912615
DATED : March 11, 2014
INVENTOR(S) : Garrett C. Casassa et al.

It is certified that error appears in the above-identified patent and that said Letters Patent is hereby corrected as shown below:

On the Title Page

(65) Prior Publication Data Insert -- This application claims benefit of 61/281,184 11/13/2009 and claims benefit of 61/340,062 March 11, 2010 --

Signed and Sealed this
Sixth Day of October, 2015

Michelle K. Lee

Michelle K. Lee
*Director of the United States Patent and Trademark Office*